US007331645B2

(12) United States Patent
Nishihara

(10) Patent No.: US 7,331,645 B2
(45) Date of Patent: Feb. 19, 2008

(54) METHOD OF DETECTING LIQUID AMOUNT, PRINTER, AND PRINTING SYSTEM

(75) Inventor: Yuichi Nishihara, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 258 days.

(21) Appl. No.: 11/274,195

(22) Filed: Nov. 16, 2005

(65) Prior Publication Data

US 2006/0187249 A1 Aug. 24, 2006

(30) Foreign Application Priority Data

Nov. 16, 2004 (JP) ..... 2004-332339

(51) Int. Cl.
*B41J 29/38* (2006.01)

(52) U.S. Cl. ..... 347/10; 347/9; 347/11

(58) Field of Classification Search ..... 347/10, 347/11, 5, 9, 68, 67
See application file for complete search history.

(56) References Cited

U.S. PATENT DOCUMENTS 6,290,315 B1 * 9/2001 Sayama ..... 347/10
6,478,395 B2 * 11/2002 Tanaka et al. ..... 347/11

FOREIGN PATENT DOCUMENTS

JP 2001-146019 A 5/2001

* cited by examiner

*Primary Examiner*—Lam Son Nguyen
(74) *Attorney, Agent, or Firm*—Sughrue Mion, PLLC

(57) ABSTRACT

The method of detecting a liquid amount includes applying a drive signal to a piezoelectric element provided at a predetermined position in a liquid containing section for containing a liquid, detecting an output signal from the piezoelectric element due to a residual vibration after the application of the drive signal, and detecting whether or not the liquid is present at the predetermined position based on the output signal utilizing difference in resonance frequency of the residual vibration depending on whether or not the liquid is present at the predetermined position. The drive signal includes a first drive waveform portion for driving the piezoelectric element at a resonance frequency of the residual vibration when the liquid is present at the predetermined position and a second drive waveform portion for driving the piezoelectric element at a resonance frequency of the residual vibration when the liquid is not present at the predetermined position.

18 Claims, 19 Drawing Sheets

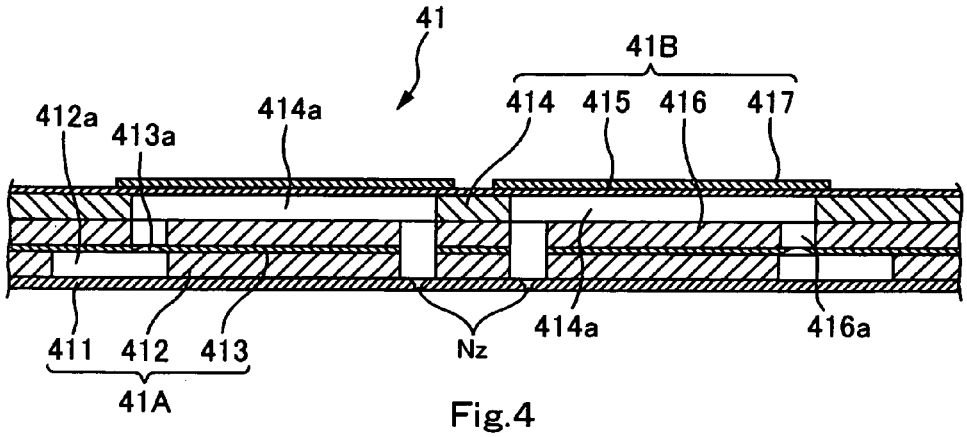
Fig.4
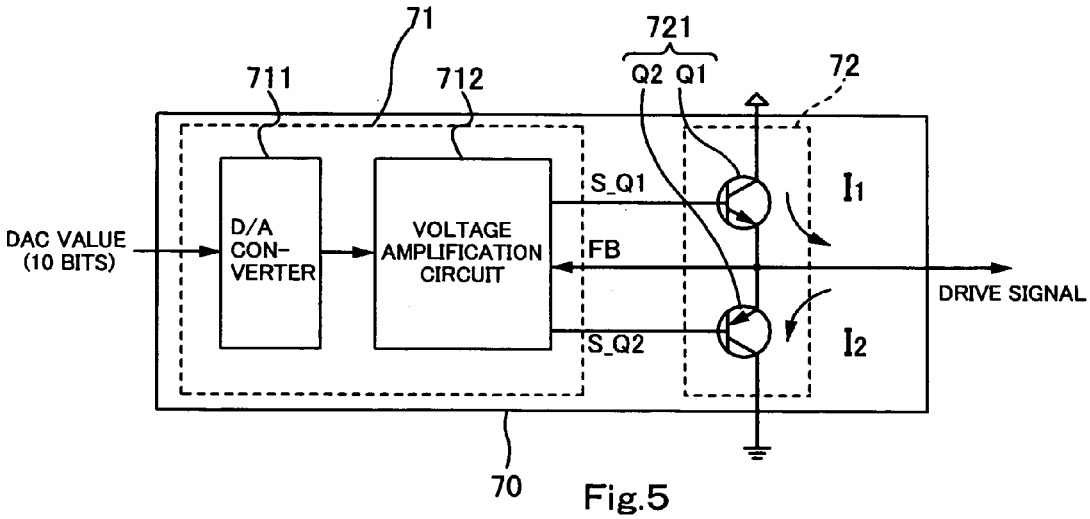
Fig.5
| DAC VALUE | OUTPUT VOLTAGE |
|---|---|
| 3FFh | 42. 32V |
| ⋮ | ⋮ |
| 24Eh | 25. 00V |
| ⋮ | ⋮ |
| 0h | 1. 40V |
Fig.6

METHOD OF DETECTING LIQUID AMOUNT, PRINTER, AND PRINTING SYSTEM

CROSS-REFERENCE TO RELATED APPLICATION

The present application claims priority upon Japanese Patent Application No. 2004-332339 filed on Nov. 16, 2004, which is herein incorporated by reference.

BACKGROUND

1. Technical Field

The present invention relates to methods of detecting the liquid amount, printers, and printing systems.

2. Related Art

Inkjet printers form dots on paper by ejecting ink droplets onto the paper. By forming such dots at predetermined locations on the paper, a print image constituted by numerous dots is printed on the paper. In such printers, ink is consumed by printing. When ink runs out, the user replaces ink cartridges.

As a method of detecting the amount of ink within an ink cartridge, a method of applying a drive signal to a piezoelectric element attached to the ink cartridge, detecting an output signal from the piezoelectric element due to a residual vibration after the application of the drive signal, and detecting the amount of remaining ink based on the output signal of the piezoelectric element is known (e.g., Japanese Patent Application Laid-Open Publication No. 2001-146019).

This detection method utilizes differences in resonance frequency of the residual vibration. That is to say, whether or not ink is present at a position where the piezoelectric element is attached is detected in such a manner that when the resonance frequency of the residual vibration detected by the piezoelectric element is, for example, 30 kHz, it is determined that ink is present, and when the resonance frequency is, for example, 100 kHz, it is determined that ink is not present.

However, when the piezoelectric element is driven at a resonance frequency of the residual vibration in the case where ink is present at the attaching position of the piezoelectric element, the residual vibration hardly occurs when ink is not present at the attaching position of the piezoelectric element. Moreover, when the piezoelectric element is driven at a resonance frequency of the residual vibration in the case where ink is not present at the attaching position of the piezoelectric element, the residual vibration hardly occurs when ink is present at the attaching position of the piezoelectric element. Consequently, whether or not ink is present may not be detected correctly.

Moreover, it requires two detection operations and therefore an increased detection time to first drive the piezoelectric element at a resonance frequency of the residual vibration in the case where ink is present at the attaching position of the piezoelectric element to detect the presence of ink at the attaching position of the piezoelectric element and then drive the piezoelectric element at a resonance frequency of the residual vibration in the case where ink is not present at the attaching position of the piezoelectric element to detect the absence of ink at the attaching position of the piezoelectric element.

SUMMARY

In view of the foregoing problems, it is an object of the present invention to apply a drive signal that excites a sufficient residual vibration for the detection regardless of whether or not ink is present at the attaching position of the piezoelectric element to the piezoelectric element.

A main invention for achieving the foregoing object is a method of detecting a liquid amount, including applying a drive signal to a piezoelectric element provided at a predetermined position in a liquid containing section for containing a liquid, detecting an output signal from the piezoelectric element due to a residual vibration after the application of the drive signal, and detecting whether or not the liquid is present at the predetermined position based on the output signal utilizing difference in resonance frequency of the residual vibration depending on whether or not the liquid is present at the predetermined position, wherein the drive signal includes a first drive waveform portion for driving the piezoelectric element at a resonance frequency of the residual vibration when the liquid is present at the predetermined position and a second drive waveform portion for driving the piezoelectric element at a resonance frequency of the residual vibration when the liquid is not present at the predetermined position.

Other features of the present invention will become clear by reading the description of the present specification with reference to the accompanying drawings.

BRIEF DESCRIPTION OF THE DRAWINGS

FIG. 4 is a cross-sectional view for explaining a structure of a head.

FIG. 5 is a block diagram for explaining a configuration of a drive signal generation circuit.

FIG. 6 is a diagram for explaining a relationship between an input of a waveform generation circuit and an output of the waveform generation circuit.

DESCRIPTION OF EXEMPLARY EMBODIMENTS

Figure 1:
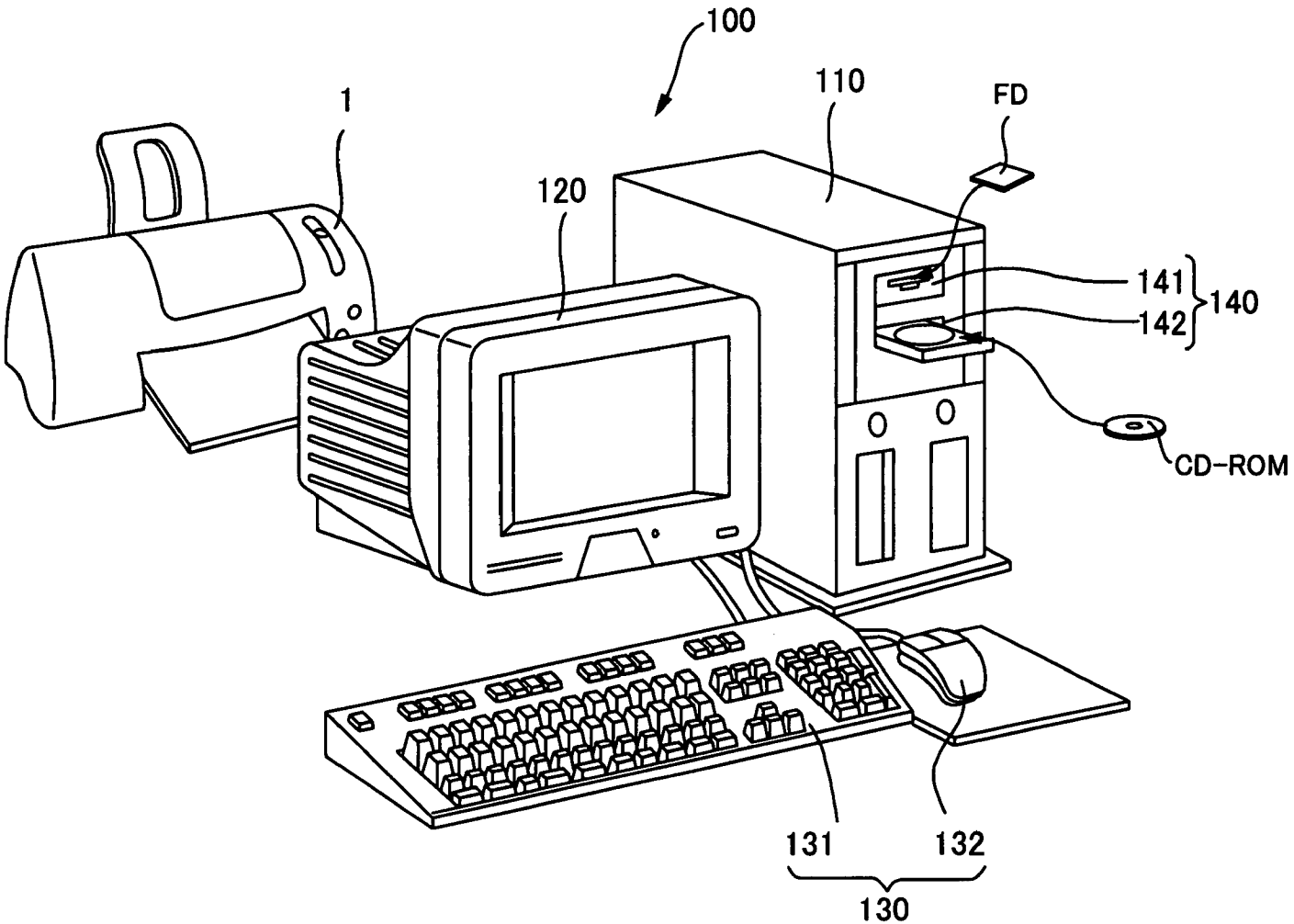
FIG. 1 is a diagram for explaining a configuration of a printing system.

At least the following matters will be made clear by the explanation in the present specification and the description of the accompanying drawings.

A method of detecting a liquid amount, including applying a drive signal to a piezoelectric element provided at a predetermined position in a liquid containing section for containing a liquid, detecting an output signal from the piezoelectric element due to a residual vibration after the application of the drive signal, and detecting whether or not the liquid is present at the predetermined position based on the output signal utilizing difference in resonance frequency of the residual vibration depending on whether or not the liquid is present at the predetermined position, wherein the drive signal includes a first drive waveform portion for driving the piezoelectric element at a resonance frequency of the residual vibration when the liquid is present at the predetermined position and a second drive waveform portion for driving the piezoelectric element at a resonance frequency of the residual vibration when the liquid is not present at the predetermined position.

According to this method of detecting a liquid amount, the residual vibration can be excited regardless of whether or not the liquid is present at the predetermined position.

In the method of detecting a liquid amount, it is desirable that of the first drive waveform portion and the second drive waveform portion, the waveform portion having the lower resonance frequency is applied first to the piezoelectric element. This is because a vibration having a lower resonance frequency is less damped. Moreover, it is desirable that the waveform portion having the lower resonance frequency is applied to the piezoelectric element a plurality of times in succession, and thereafter the waveform portion having the higher resonance frequency is applied to the piezoelectric element. This is because the amplitude of a vibration having a lower resonance frequency is less increased.

In the method of detecting a liquid amount, it is desirable that the first drive waveform portion is applied to the piezoelectric element, and thereafter the second drive waveform portion is applied to the piezoelectric element. This is because the residual vibration is less damped when the liquid is present at the predetermined position. Moreover, it is desirable that the first drive waveform portion is applied to the piezoelectric element a plurality of times in succession, and thereafter the second drive waveform portion is applied to the piezoelectric element. This is because the amplitude of the residual vibration is less increased when the liquid is present at the predetermined position.

In the method of detecting a liquid amount, it is desirable that the first drive waveform portion and the second drive waveform portion drive the piezoelectric element for a duration corresponding to the resonance frequency of the residual vibration. Moreover, it is preferable that the first drive waveform portion is a signal that drives the piezoelectric element for a duration corresponding to ¼ of a cycle of the residual vibration when the liquid is present at the predetermined position. Thus, the residual vibration is excited when the liquid is present at the predetermined position. Moreover, it is preferable that the second drive waveform portion is a signal that drives the piezoelectric element for a duration corresponding to ¼ of a cycle of the residual vibration when the liquid is not present at the predetermined position. Thus, the residual vibration is excited when the liquid is not present at the predetermined position.

In the method of detecting a liquid amount, it is desirable that a drive signal generation section generates an ejection drive signal for ejecting the liquid contained in the liquid containing section, a drive element that is different from the piezoelectric element is driven by the ejection drive signal so that the liquid is ejected from a nozzle, the drive signal generation section generates the drive signal including the first drive waveform portion and the second drive waveform portion, and the piezoelectric element is driven by the drive signal. This allows sharing of the drive signal generation section.

In the method of detecting a liquid amount, it is desirable that a signal generated by the drive signal generation section is applied to either one of the drive element and the piezoelectric element by switching a switch. Thus, the signal generated by the drive signal generation section can be selectively applied to either one of the drive element and the piezoelectric element. However, it is also possible that a switch for applying a signal generated by the drive signal generation section to the piezoelectric element is provided.

In the method of detecting a liquid amount, it is desirable that a voltage of the drive signal is higher than a voltage of a power source for operating a control circuit of a head for ejecting the liquid. Thus, the piezoelectric element can be driven with a high voltage.

In the method of detecting a liquid amount, it is desirable that a buffer compartment for preventing the piezoelectric element from being affected by a state of the liquid in the liquid containing section is provided near the predetermined position. Thus, the residual vibration can be detected without being affected by the state (e.g., vibration) of the liquid in the liquid containing section.

In the method of detecting a liquid, it is desirable that the liquid containing section is provided with an opening, the opening is closed by a vibration plate, the vibration plate is provided with the piezoelectric element, and the center of the opening coincides with the center of the piezoelectric element. Thus, the resonance frequency of the vibration plate can be detected accurately.

In the method of detecting a liquid amount, it is desirable that the liquid is ink. Thus, it is possible to detect, for example, the amount of ink remaining in an ink cartridge for use in printers.

A printer including a mounting section on which a liquid containing section for containing a liquid is mounted removably, the liquid containing section being provided with a piezoelectric element at a predetermined position in the liquid containing section; a drive signal generation section for generating a drive signal to be applied to the piezoelectric element; and a controller for applying the drive signal to the piezoelectric element, detecting an output signal from the piezoelectric element due to a residual vibration thereafter, and detecting whether or not the liquid is present at the predetermined position based on the output signal utilizing difference in resonance frequency of the residual vibration depending on whether or not the liquid is present at the predetermine position, wherein the drive signal includes a first drive waveform portion for driving the piezoelectric element at a resonance frequency of the residual vibration when the liquid is present at the predetermined position and a second drive waveform portion for driving the piezoelectric element at a resonance frequency of the residual vibration when the liquid is not present at the predetermined position.

With this printer, the residual vibration can be excited regardless of whether or not the liquid is present at the predetermined position, so that the liquid amount can be detected accurately.

A printing system including a computer and a printer connected to the computer, wherein the printer includes a mounting section on which a liquid containing section for containing a liquid is mounted removably, the liquid containing section being provided with a piezoelectric element at a predetermined position in the liquid containing section; a drive signal generation section for generating a drive signal to be applied to the piezoelectric element; and a controller for applying the drive signal to the piezoelectric element, detecting an output signal from the piezoelectric element due to a residual vibration thereafter, and detecting whether or not the liquid is present at the predetermined position based on the output signal utilizing difference in resonance frequency of the residual vibration depending on whether or not the liquid is present at the predetermined position, wherein the drive signal includes a first drive waveform portion for driving the piezoelectric element at a resonance frequency of the residual vibration when the liquid is present at the predetermined position and a second drive waveform portion for driving the piezoelectric element at a resonance frequency of the residual vibration when the liquid is not present at the predetermined position.

With this printing system, the residual vibration can be excited regardless of whether or not the liquid is present at the predetermined position, so that the liquid amount can be detected accurately.

===Configuration of the Printing System===

<Regarding the Overall Configuration>

FIG. 1 is a diagram for explaining a configuration of a printing system 100. The illustrated printing system 100 includes a printer 1 as a printing apparatus and a computer 110 as a print control apparatus. More specifically, the printing system 100 has the printer 1, the computer 110, a display device 120, an input device 130, and a recording and reproducing device 140.

The printer 1 prints images on media such as paper, cloth, and film. The computer 110 is communicably connected to the printer 1. In order to print an image with the printer 1, the computer 110 outputs print data corresponding to that image to the printer 1. The computer 110 has computer programs such as an application program and a printer driver installed therein. The display device 120 has a display. The display device 120 is a device for displaying, for example, a user interface of the computer programs. The input device 130 is, for example, a keyboard 131 and a mouse 132. The recording and reproducing device 140 is, for example, a flexible disk drive device 141 and a CD-ROM drive device 142.

===The Computer===

<Regarding the Configuration of the Computer 110>

Figure 2:
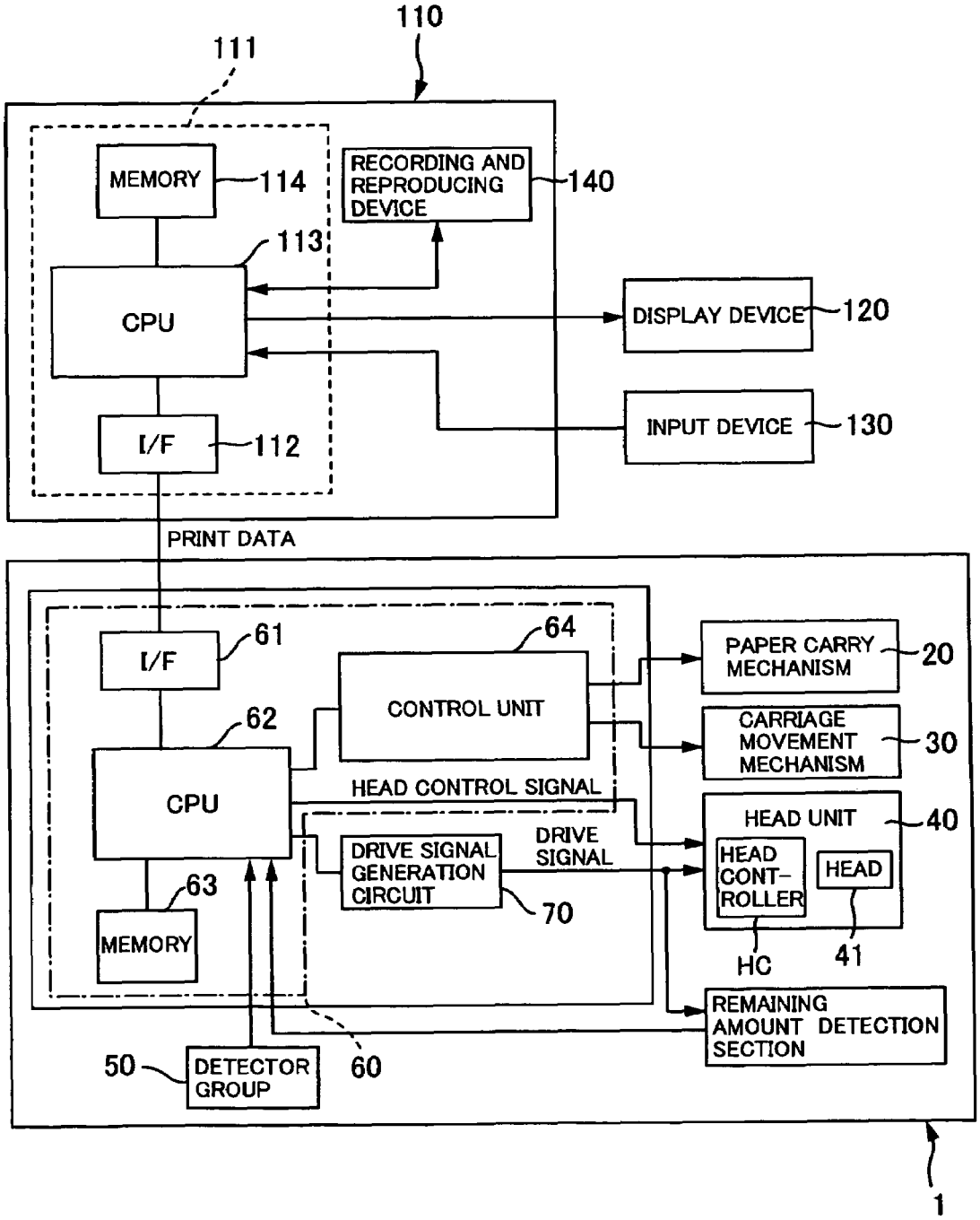
FIG. 2 is a block diagram for explaining configurations of a computer and a printer.

FIG. 2 is a block diagram for explaining configurations of the computer 110 and the printer 1. First, the configuration of the computer 110 is described briefly. The computer 110 has the above-mentioned recording and reproducing device 140 and a host controller 111. The recording and reproducing device 140 is communicably connected to the host controller 111 and attached to, for example, a housing of the computer 110. The host controller 111 performs various controls in the computer 110 and is also communicably connected to the above-mentioned display device 120 and input device 130. The host controller 111 has an interface section 112, a CPU 113, and a memory 114. The interface section 112 is interposed between the computer and the printer 1 and exchanges data with the printer 1. The CPU 113 is a computing processing unit for performing the overall control of the computer 110. The memory 114 is for reserving an area for storing computer programs used by the CPU 113 and a working area, for example, and is constituted by a RAM, an EEPROM, a ROM, or a magnetic disk device, for example. Examples of the computer programs that are stored on the memory 114 include the application program and the printer driver as described above. The CPU 113 performs various controls according to the computer programs stored on the memory 114.

The printer driver allows the computer 110 to convert image data into print data and sends the print data to the printer 1. The print data is data having a form that can be understood by the printer 1, and has various types of command data and pixel data SI (see FIG. 8, for example). The command data is data for directing the printer 1 to execute a particular operation. Examples of the command data include command data for directing paper supply, command data for indicating the carry amount, and command data for directing paper discharge.

===The Printer===

<Regarding the Configuration of the Printer 1>

Figure 3A:
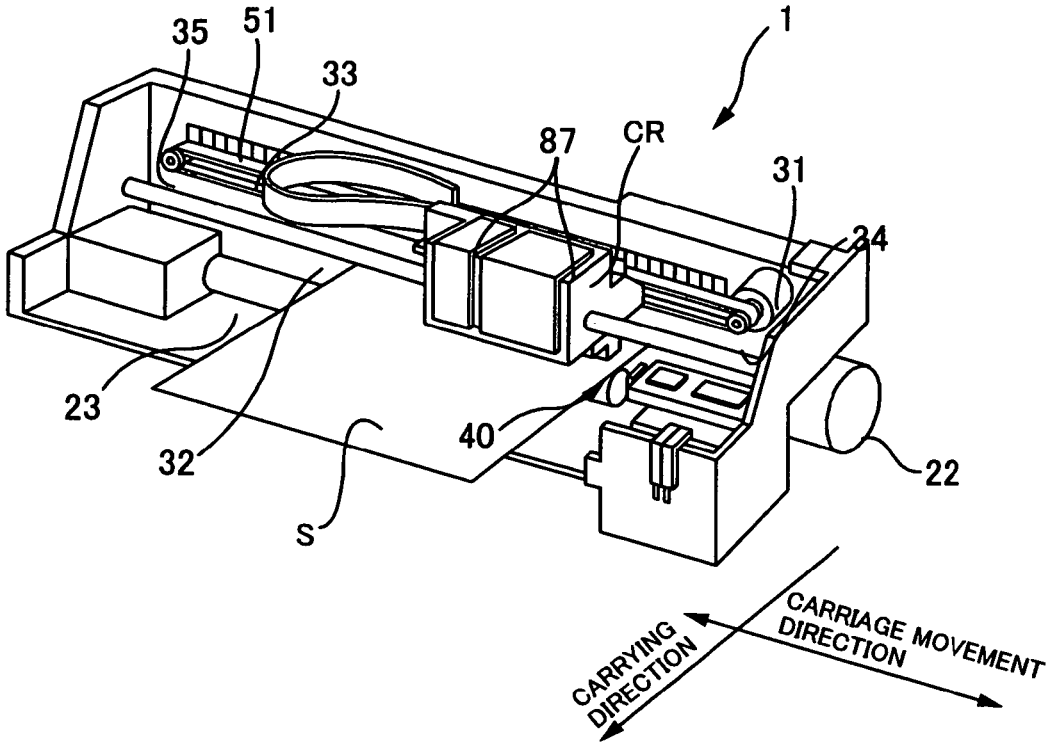
FIG. 3A is a diagram showing a configuration of a printer of the present embodiment.
Figure 3B:
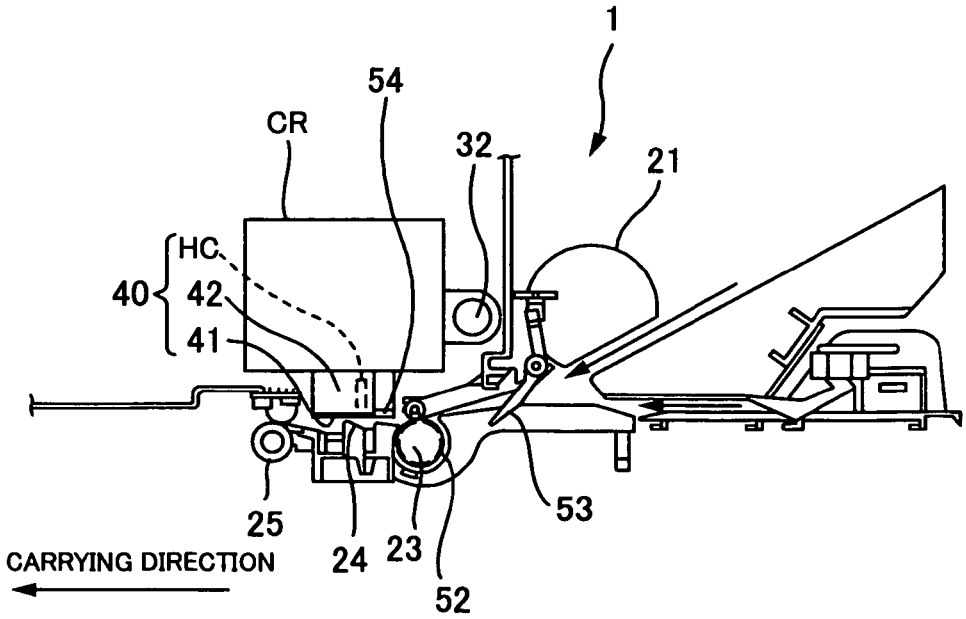
FIG. 3B is a side view for explaining the configuration of the printer of the present embodiment.

FIG. 3A is a diagram showing a configuration of the printer 1 of the present embodiment. FIG. 3B is a side view for explaining the configuration of the printer 1 of the present embodiment. In the following description, reference also is made to FIG. 2.

The printer 1 has a paper carry mechanism 20, a carriage movement mechanism 30, a head unit 40, a detector group 50, a printer controller 60, and a drive signal generation circuit 70. In the present embodiment, the printer controller 60 and the drive signal generation circuit 70 are provided on a common controller board CTR. Moreover, the head unit 40 has a head controller HC and a head 41.

In the printer 1, the printer controller 60 controls the sections to be controlled, i.e., the paper carry mechanism 20, the carriage movement mechanism 30, the head unit 40 (head controller HC, head 41), and the drive signal generation circuit 70. Thus, based on the print data received from the computer 110, the printer controller 60 controls so that the image is printed on the paper S. Moreover, detectors in the detector group 50 monitor the conditions in the printer 1. The detectors output detection results to the printer controller 60. The printer controller 60 that has received the detection results from the detectors controls the sections to be controlled based on the detection results.

<Regarding the Paper Carry Mechanism 20>

The paper carry mechanism 20 corresponds to a medium carry section for carrying the media. The paper carry mechanism 20 feeds the paper S into a printable position and carries the paper S in a carrying direction with a predetermined carry amount. The carrying direction is a direction that intersects a carriage movement direction. The paper carry mechanism 20 has a paper supplying roller 21, a carry motor 22, a carry roller 23, a platen 24, and a paper-discharge roller 25. The paper supply roller 21 is a roller for automatically feeding the paper S that has been inserted into a paper insert opening into the printer 1, and in this example has a D-shaped cross-sectional shape. The carry motor 22 is a motor for carrying the paper S in the carrying direction, and its operation is controlled by the printer controller 60. The carry roller 23 is a roller for carrying the paper S that has been supplied by the paper supplying roller 21 to a printable region. The operation of the carry roller 23 also is controlled by the carry motor 22. The platen 24 is a member that supports the paper S from the rear surface of the paper S during printing. The paper-discharge roller 25 is a roller for carrying the paper S for which printing has finished.

<Regarding the Carriage Movement Mechanism 30>

The carriage movement mechanism 30 is for moving a carriage CR to which the head unit 40 is attached in the carriage movement direction. The carriage movement direction includes a movement direction from one side to the other side and a movement direction opposite to this movement direction. It should be noted that since the head unit 40 has the head 41, the carriage movement direction corresponds to a movement direction of the head 41, and the carriage movement mechanism 30 corresponds to a head movement section that moves the head 41 in that movement direction. The carriage movement mechanism 30 has a carriage motor 31, a guide shaft 32, a timing belt 33, a driving pulley 34, and a driven pulley 35. The carriage motor 31 corresponds to a drive source for moving the carriage CR. The operation of the carriage motor 31 is controlled by the printer controller 60. The driving pulley 34 is attached to a rotation shaft of the carriage motor 31. The driving pulley 34 is disposed on one end side of the carriage movement direction. The driven pulley 35 is disposed on the other end side of the carriage movement direction, which is opposite to the driving pulley 34. The timing belt 33 is connected to the carriage CR and extended between the driving pulley 34 and the driven pulley 35. The guide shaft 32 supports the carriage CR in a manner in which the carriage CR can move. The guide shaft 32 is attached along the carriage movement direction. Therefore, when the carriage motor 31 operates, the carriage CR moves in the carriage movement direction along the guide shaft 32.

An ink cartridge 87 is removably mounted on the carriage CR. The ink cartridge 87 contains ink, which is supplied to the head 41. It should be noted that the ink cartridge of the present embodiment is provided with a liquid level detection section 90 (described later) for detecting the amount of remaining ink contained therein.

<Regarding the Head Unit 40>

The head unit 40 is for ejecting ink toward the paper S. The head unit 40 is attached to the carriage CR. The head 41 of the head unit 40 is provided on the lower surface of a head case 42. Moreover, the head controller HC of the head unit 40 is provided inside the head case 42. The head controller HC is described in greater detail later.

FIG. 4 is a cross-sectional view for explaining a structure of the head 41. The illustrated head 41 has a channel unit 41A and an actuator unit 41B. The channel unit 41A has a nozzle plate 411 in which nozzles Nz are provided, a reservoir forming substrate 412 in which openings serving as ink reservoirs 412*a* are formed, and a supply port forming substrate 413 in which ink supply ports 413*a* are formed. The actuator unit 41B has a pressure compartment forming substrate 414 in which openings serving as pressure compartments 414*a* are formed, a vibration plate 415 that partitions a portion of the pressure compartments 414*a*, a lid member 416 in which openings serving as supply-side communicating holes 416*a* are formed, and piezo elements 417 formed on the surface of the vibration plate 415. In the head 41, continuous channels leading from the ink reservoirs 412*a* via the pressure compartments 414*a* to the nozzles Nz are formed. At the time of use, the channels are filled up with ink, and by deforming the piezo elements 417, ink can be ejected from the corresponding nozzles Nz. Therefore, in this head 41, the piezo elements 417 correspond to elements that can execute the operation for ejecting ink.

From each nozzle Nz, different amounts of a plurality of types of ink can be ejected. For example, three types of ink, i.e., a large ink droplet containing the amount of ink that can form a large dot, a medium ink droplet containing the amount of ink that can form a medium dot, and a small ink droplet containing the amount of ink that can form a small dot, can be ejected from each nozzle Nz. Thus, the printer 1 can achieve four gradation levels, i.e., no dot formation, a small dot, a medium dot, and a large dot, for each pixel on the paper S.

<Regarding the Detector Group 50>

The detector group 50 is for monitoring the conditions in the printer 1. As shown in FIG. 3A and FIG. 3B, the detector group 50 includes a linear encoder 51, a rotary encoder 52, a paper detector 53, an optical sensor 54, and the like. The linear encoder 51 is for detecting the position of the carriage CR (head 41, nozzles Nz) in the carriage movement direction. The rotary encoder 52 is for detecting the amount of rotation of the carry roller 23. The paper detector 53 is for detecting the position of the front end of the paper S to be printed. The optical sensor 54, which is provided on the carriage CR, is capable of detecting whether or not the paper S is present in the position opposite thereto and, for example, can detect the width of the paper S by detecting the edges of the paper S while moving.

<Regarding the Printer Controller 60>

The printer controller 60 performs control of the printer 1. The printer controller 60 has an interface section 61, a CPU 62, a memory 63, and a control unit 64. The interface section 61 exchanges data with the computer 110, which is an external apparatus. The CPU 62 is a computing processing unit for performing the overall control of the printer 1. The memory 63 is for reserving an area for storing programs for the CPU 62 and a working area, for example, and is constituted by a storage element such as a RAM, an EEPROM, or a ROM. The CPU 62 controls the sections to be controlled according to the computer programs stored on the memory 63. For example, the CPU 62 controls the paper carry mechanism 20 and the carriage movement mechanism 30 via the control unit 64.

Moreover, the CPU 62 outputs head control signals for controlling the operation of the head 41 to the head controller HC and outputs a control signal for generating a drive signal COM to the drive signal generation circuit 70. The head control signals include transfer clock CLK, pixel data SI, a latch signal LAT, a change signal, and the like. Moreover, the control signal for generating the drive signal COM includes a DAC value described later.

<Regarding the Drive Signal Generation Circuit 70>

The drive signal generation circuit 70 generates a drive signal for driving the piezo elements and corresponds to the drive signal generation section. In the present embodiment, the drive signal generation circuit 70 generates, as the drive signal, an ejection drive signal COM used in common for the plurality of piezo elements 417, which are provided for the respective nozzles, or a detection drive signal for driving a detection piezo element 911 that is provided for use in the detection of the ink amount described later.

FIG. 5 is a block diagram for explaining a configuration of the drive signal generation circuit 70. The drive signal generation circuit 70 has a waveform generation circuit 71 and a current amplification circuit 72. FIG. 6 is a diagram for explaining a relationship between the DAC value input to the waveform generation circuit 71 and an output voltage output from the waveform generation circuit 71.

The waveform generation circuit 71 has a D/A converter 711 and a voltage amplification circuit 712. The D/A converter 711 is an electric circuit that outputs a voltage signal according to the DAC value. The DAC value provides information for specifying the voltage (hereinafter also referred to as "output voltage") to be output from the voltage amplification circuit 712, and is output from the CPU 62 based on waveform data stored on the memory 63. In the present embodiment, the DAC value is constituted by 10 bits of data, but is shown as a hexadecimal value in the drawing for the sake of convenience.

The voltage amplification circuit 712 amplifies the output voltage from the D/A converter 711 to a voltage suited for the operation of the piezo elements 417. In the voltage amplification circuit 712 of the present embodiment, the output voltage from the D/A converter 711 is amplified to up to 40 several volts. The amplified output voltage is then output as a control signal S_Q1 and a control signal S_Q2 to the current amplification circuit 72.

For example, when the DAC value input from the CPU 62 to the D/A converter 711A is "24Eh" in hexadecimal representation ("1001001110" in binary representation), the output voltage after being amplified in the voltage amplification circuit 712 is 25 V. Moreover, when the DAC value input from the CPU 62 to the D/A converter 711 is "0 h" in hexadecimal representation ("0000000000" in binary representation), the output voltage after being amplified in the voltage amplification circuit 712 is 1.4 V, and when the DAC value input is "3FF" in hexadecimal representation ("1111111111" in binary representation), the output voltage after being amplified in the voltage amplification circuit 712 is 42.32 V. That is to say, the minimum output voltage of the waveform generation circuit 71 is 1.4 V, and the output voltage of the waveform generation circuit increases by 0.04 V each time the DAC value input from the CPU 62 is incremented by one.

The current amplification circuit 72 is a circuit for supplying a sufficient current so that the numerous piezo elements 417 can operate without any trouble. The current amplification circuit 72 has a transistor pair 721. The transistor pair 721 has an NPN transistor Q1 and a PNP transistor Q2 whose emitter terminals are connected to each other. The NPN transistor Q1 is a transistor that operates when the voltage of the drive signal increases. The NPN transistor Q1 has a collector and an emitter connected to a power source and an output signal line for the drive signal, respectively. The PNP transistor Q2 is a transistor that operates when the voltage decreases. The PNP transistor Q2 has a collector and an emitter connected to the ground (earth) and the output signal line for the drive signal, respectively. It should be noted that the voltage (voltage of the drive signal) at a junction of the emitters of the NPN transistor Q1 and the PNP transistor Q2 is fed back to the voltage amplification circuit 712, as shown by a sign FB.

The operation of the current amplification circuit 72 is controlled by the output voltage from the waveform generation circuit 71. For example, when the output voltage increases, the NPN transistor Q1 is turned on by the control signal S_Q1. Accordingly, a current I1 flows, and the voltage of the drive signal also increases. On the other hand, when the output voltage decreases, the PNP transistor Q2 is turned on by the control signal S_Q2. Accordingly, a current I2 flows, and the voltage of the drive signal also decreases. It should be noted that when the output voltage is kept constant, both of the NPN transistor Q1 and the PNP transistor Q2 are turned off. Consequently, the drive signal is kept at a constant voltage.

<Regarding the Operation of the Drive Signal Generation Circuit 70>

Figure 7A:
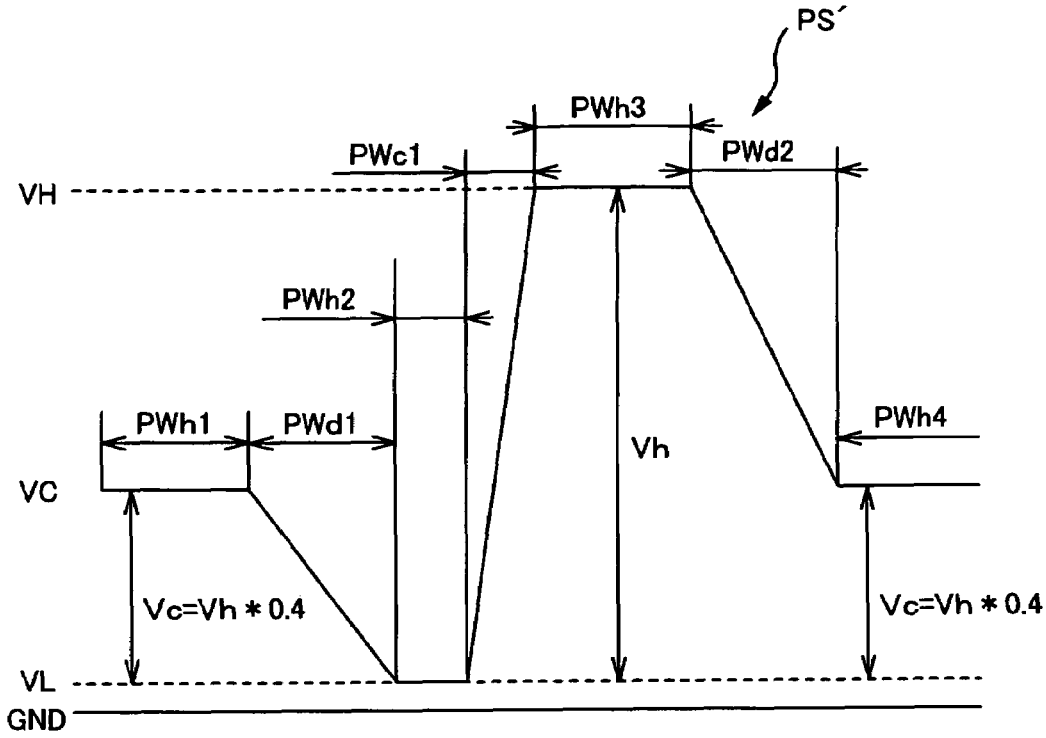
FIG. 7A is a diagram for explaining a portion of a drive signal generated by the drive signal generation circuit 70.
Figure 7B:
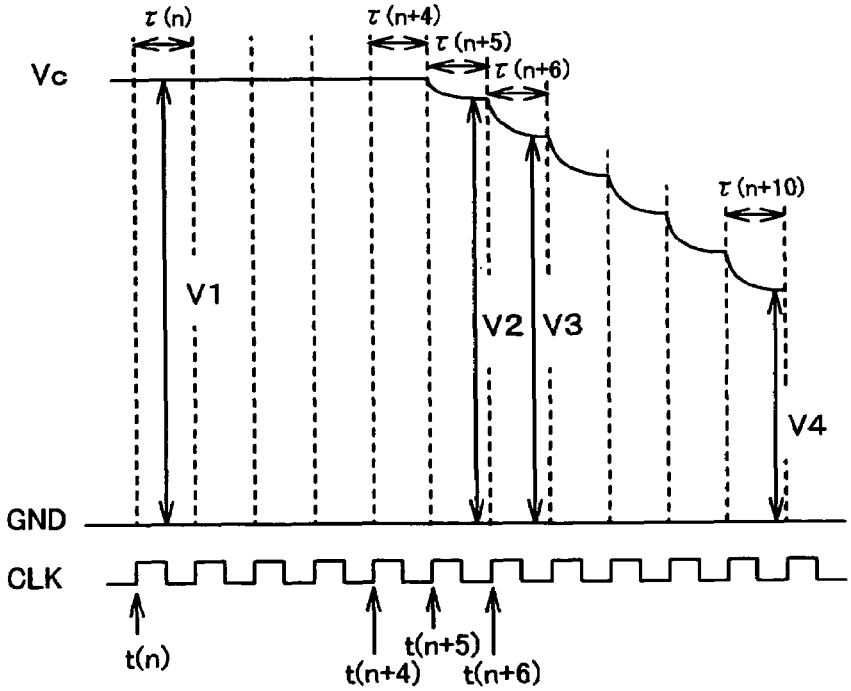
FIG. 7B is a diagram for explaining an operation of decreasing an output voltage of a current amplification circuit 72 from a voltage V1 to a voltage V4.

FIG. 7A is a diagram for explaining a portion of the drive signal that is generated by the drive signal generation circuit 70. FIG. 7B is a diagram for explaining an operation of decreasing the output voltage of the current amplification circuit 72 from a voltage V1 to a voltage V4.

The CPU 62 of the printer controller 60 first obtains the output voltage for each update cycle $\tau$ based on parameters for generating the drive signal. Taking a drive pulse PS' shown in FIG. 7A as an example, the parameters include a drive voltage Vh, a ratio that defines the relationship between the drive voltage Vh and a reference voltage Vc, a time period PWh1 during which an intermediate voltage VC is maintained, a time period PWd1 during which the voltage is decreased from the intermediate voltage VC to a lowest voltage VL with a constant slope, a time period PWh2 during which the lowest voltage VL is maintained, a time period PWc1 during which the voltage is increased from the lowest voltage VL to a highest voltage VH with a constant slope, a time period PWh3 during which the highest voltage VH is maintained, a time period PWd2 during which the voltage is decreased from the highest voltage VH to the intermediate voltage VC with a constant slope, and a time period PWh4 during which the intermediate voltage VC is maintained.

Here, the drive voltage Vh is a voltage difference between the highest voltage VH and the lowest voltage VL in the drive pulse PS'. In other words, it corresponds to the difference between a lowest potential (potential determined by the lowest voltage VL) and a highest potential (potential determined by the highest voltage VH) in the piezo elements 417. The reference voltage Vc determines a deformation state of the piezo elements 417 that serves as the reference. In the present embodiment, the reference voltage Vc is 40% of the drive voltage Vh. Thus, the value "0.4" is stored as the ratio that defines the relationship between the drive voltage Vh and the reference voltage Vc. The intermediate voltage VC is a voltage obtained by adding the reference voltage Vc to the lowest voltage VL. Moreover, the highest voltage VH is a voltage obtained by adding the drive voltage Vh to the lowest voltage VL. These parameters are stored on the memory 63.

The CPU 62 determines the drive voltage Vh based on the parameters stored on the memory 63. Once the drive voltage Vh is determined, the CPU 62 calculates the reference voltage Vc, the intermediate voltage VC, and the highest voltage VH. Then, the CPU 62 obtains the output voltage for each update cycle τ using the above-mentioned time period PWh1 to time period PWh4. The update cycle τ is, for example, 0.1 μs (clock CLK=10 MHz) to 0.05 μs (clock CLK=20 MHz). Then, based on the obtained output voltage for each update cycle τ, the DAC value for each update cycle τ is determined and stored in the working area (not shown) of the memory 63, for example.

When generating the drive signal, the CPU 62 sequentially outputs the DAC values for the respective update cycles τ to the D/A converter 711A. In the example of FIG. 7B, a DAC value corresponding to the voltage V1 is output at a timing t(n) defined by the clock CLK. Thus, the voltage V1 is output from the voltage amplification circuit 712 in a cycle τ(n). Then, DAC values corresponding to the voltage V1 are sequentially input from the CPU 62 to the D/A converter 711 and the voltage V1 continues to be output from the voltage amplification circuit 712 until an update cycle τ(n+4). Moreover, at a timing t(n+5), a DAC value corresponding to a voltage V2 is input from the CPU 62 to the D/A converter 711. Thus, in a cycle τ(n+5), the output of the voltage amplification circuit 712 is decreased from the voltage V1 to the voltage V2. Similarly, at a timing t(n+6), a DAC value corresponding to a voltage V3 is input from the CPU 62 to the D/A converter 711, and the output of the voltage amplification circuit 712 is decreased from the voltage V2 to the voltage V3. Thereafter, DAC values are sequentially input to the D/A converter 711 in the same manner, so that the voltage output from the voltage amplification circuit 712 is decreased gradually. In a cycle τ(n+10), the output of the voltage amplification circuit 712 is decreased to the voltage V4.

In this manner, the signal shown in FIG. 7A is output from the waveform generation circuit 71, and then output from the current amplification circuit 72 as the drive signal.

<Regarding the Head Controller HC>

Figure 8:
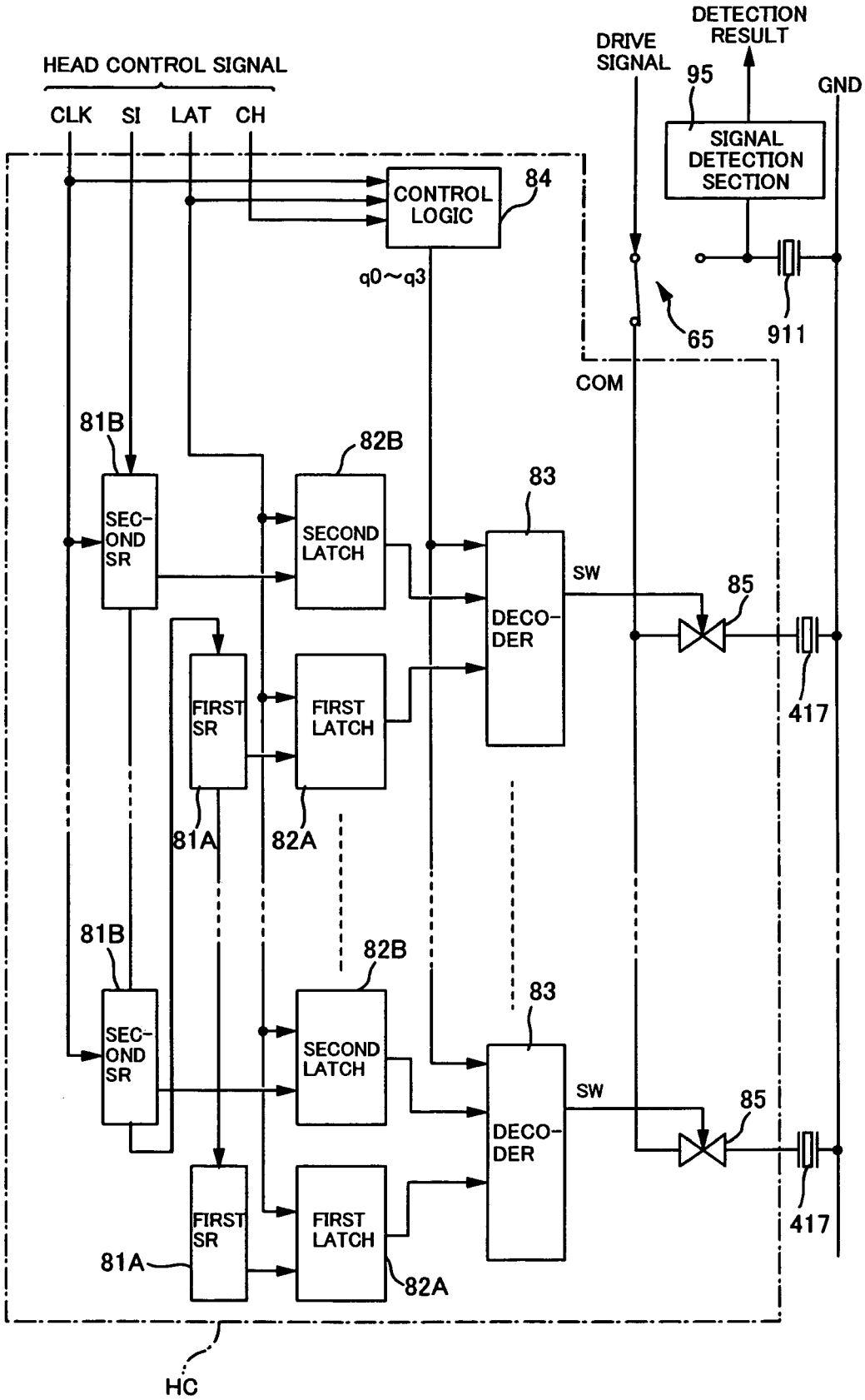
FIG. 8 is a block diagram for explaining a configuration of a head controller HC.
Figure 9:
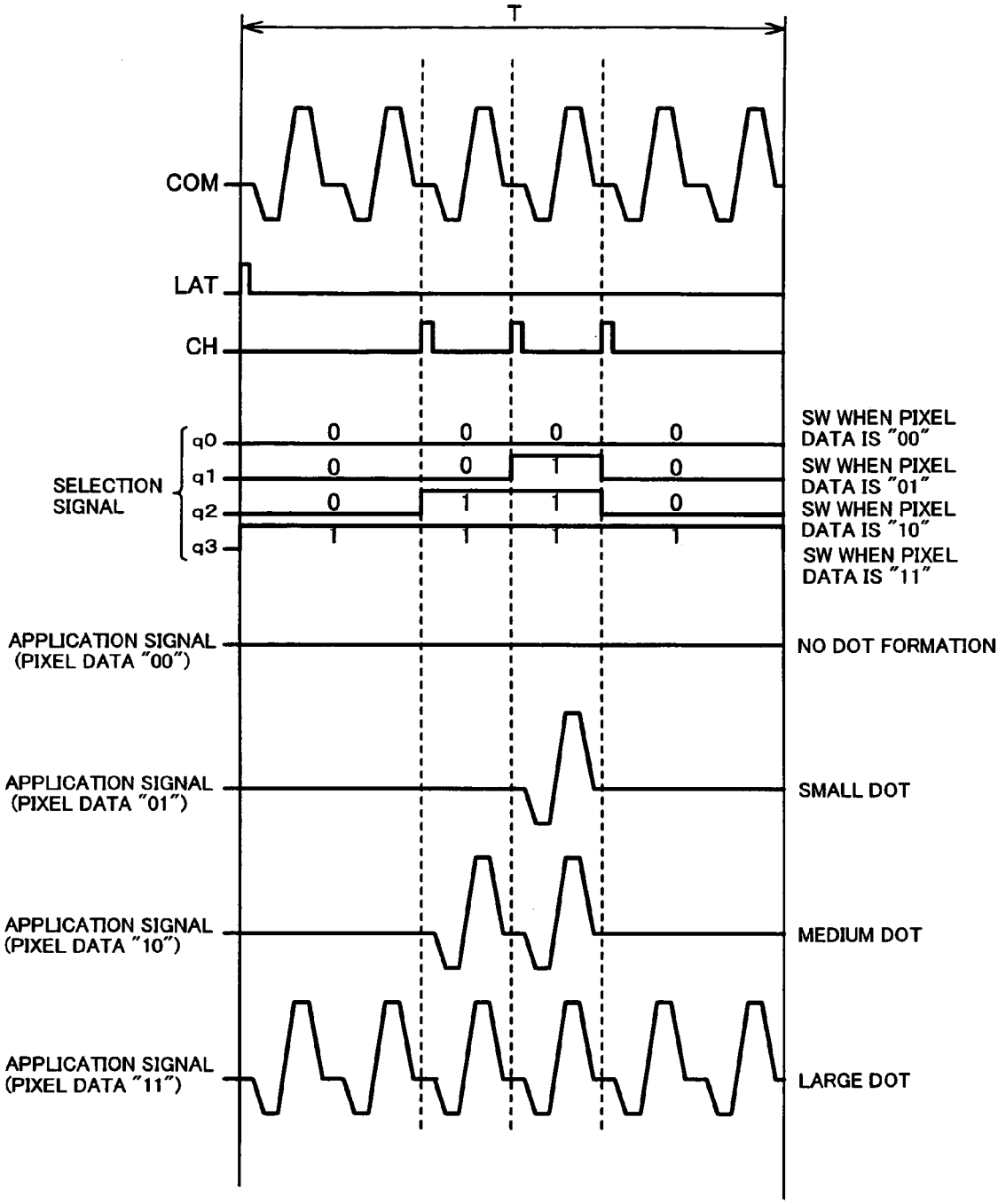
FIG. 9 shows an ejection drive signal COM.

FIG. 8 is a block diagram for explaining a configuration of the head controller HC. FIG. 9 shows the ejection drive signal COM.

As shown in the drawing, the head controller HC receives the head control signals from the printer controller 60. Moreover, the drive signal output from the drive signal generation circuit 70 is input to a selection switch 65 that is provided upstream of the head controller HC. When the selection switch 65 is connected to a terminal on the head controller HC side, the drive signal output from the drive signal generation circuit 70 is input to the head controller HC as the ejection drive signal COM used in common for the plurality of piezo elements.

The head controller HC is provided with a first shift register 81A, a second shift register 81B, a first latch circuit 82A, a second latch circuit 82B, a decoder 83, a control logic 84, and a switch 85. The sections other than the control logic 84, i.e., the first shift register 81A, the second shift register 81B, the first latch circuit 82A, the second latch circuit 82B, the decoder 83, and the switch 85, are provided for each piezo element 417. Since a piezo element 417 is provided for each nozzle, in other words, these sections are provided for each nozzle.

The head controller HC performs control for ejecting ink, based on the print data (pixel data SI) from the printer controller 60. In the present embodiment, the pixel data is constituted by two bits, and the pixel data is transmitted to the recording head 41 in synchronization with the clock signal CLK. The pixel data is transmitted in order from a high-order bit group to a low-order bit group. Each nozzle row of the head 41 in the present embodiment has a total of 180 nozzles, a first nozzle #1 to a 180th nozzle #180. Thus, the pixel data is transmitted in the order of a high-order bit for the nozzle #1, a high-order bit for a nozzle #2, . . . , a high-order bit for a nozzle #179, a high-order bit for the nozzle #180, a low-order bit for the nozzle #1, a low-order bit for the nozzle #2, . . . , a low-order bit for the nozzle #179, and a low-order bit for the nozzle #180. Consequently, the high-order bit group of each pixel data is set in the first shift registers 81A, and the low-order bit group is set in the second shift registers 81B.

The first shift registers 81A are electrically connected to the first latch circuits 82A, and the second shift registers 81B are electrically connected to the second latch circuits 82B. When the latch signal LAT from the printer controller 60 is turned to a H level, that is to say, when a latch pulse is input to the first latch circuits 82A and the second latch circuits 82B, the first latch circuits 82A latch the high-order bits in the first shift registers 81A, and the second latch circuits 82B latch the low-order bits in the second shift registers 81B.

The first latch circuits 82A and the second latch circuits 82B are electrically connected to the corresponding decoders 83. The pixel data (sets of the high-order bit and the low-order bit) latched by the first latch circuits 82A and the second latch circuits 82B is input to the decoders 83 respectively.

FIG. 9 shows the latch signal LAT and the change signal CH. FIG. 9 also shows waveform selection signals q0 to q3.

The control logic 84 receives the latch signal LAT and the change signal CH from the CPU 62. The control logic 84 generates the waveform selection signals q0 to q3 based on the latch signal LAT and the change signal CH. The waveform selection signals q0 to q3 generated by the control logic 84 are input to the decoders 83.

The decoder 83 outputs a switch control signal SW for controlling the on/off of the switch 85, based on the pixel data latched by the first latch circuit 82A and the second latch circuit 82B. When the pixel data is "00", the decoder 83 outputs the waveform selection signal q0 as the switch control signal SW. When the pixel data is "01", the decoder outputs a waveform selection signal q1 as the switch control signal SW. When the pixel data is "10", the decoder 83 outputs a waveform selection signal q2 as the switch control signal SW1. When the pixel data is "11", the decoder 83 outputs the waveform selection signal q3 as the switch control signal SW. When the switch control signal SW is at the H level, the switch 85 is turned on, and when the switch control signal SW is at a L level, the switch 85 is turned off.

The drive signal COM is input in common to the switches 85. When a given switch 85 is turned on, the drive signal COM is input to the corresponding piezo element 417. When the switch 85 is turned off, the drive signal COM is not input to the piezo element 417. The output side of the switch 85 is electrically connected to the piezo element 417. By turning the switch 85 on or off, waveform portions constituting the drive signal COM are selectively applied to the piezo element 417.

FIG. 9 shows application signals to be applied to the piezo element 417. As a result, when the pixel data is "00", none of the six pulses contained in the drive signal COM is applied, and the piezo element 417 is not driven, so that an ink droplet is not ejected. When the pixel data is "01", one pulse contained in the drive signal COM is applied, and the piezo element 417 is driven according to this pulse, so that a small ink droplet is ejected, forming a small dot on the paper. In the same manner, when the pixel data is "10", two pulses contained in the drive signal COM are applied, so that a medium dot is formed on the paper. Moreover, when the pixel data is "11", the six pulses contained in the drive signal COM are applied, so that a large dot is formed on the paper.

<Regarding the Printing Process>

Figure 10:
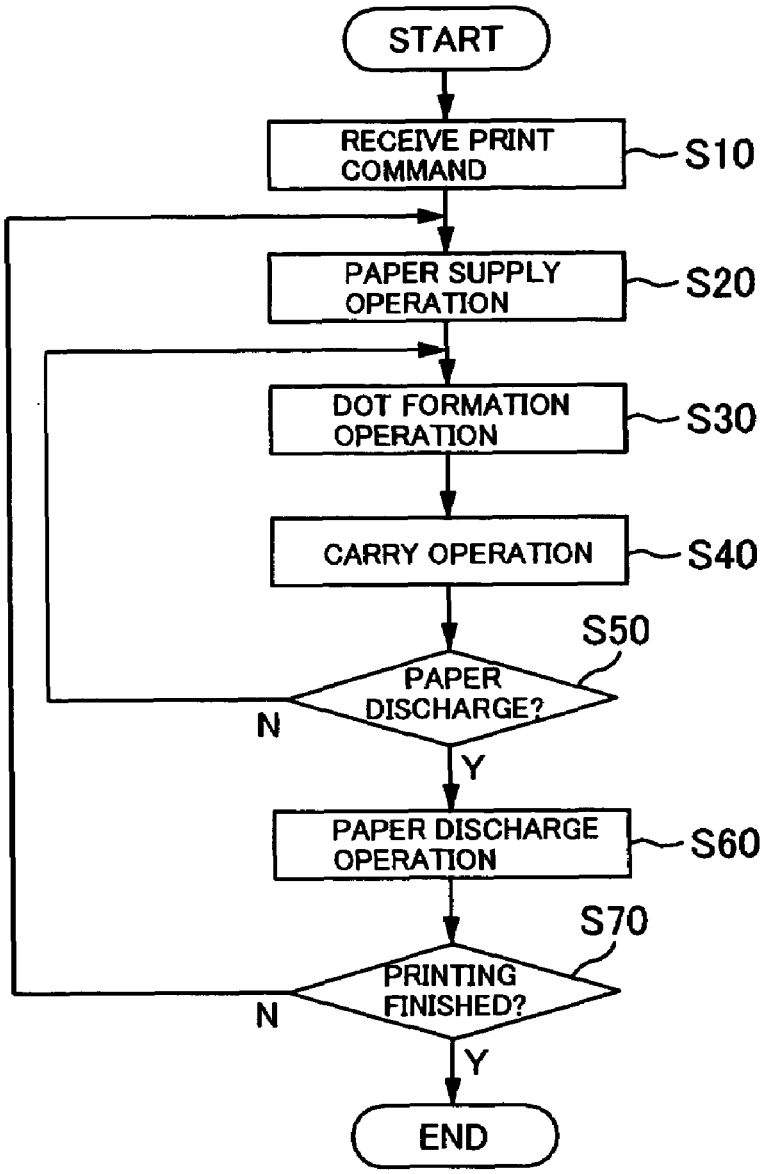
FIG. 10 is a flowchart for explaining a printing process.

FIG. 10 is a flowchart for explaining a printing process. In the printer 1 having the above-described configuration, the printer controller 60 controls the sections to be controlled (paper carry mechanism 20, carriage movement mechanism 30, head unit 40, drive signal generation circuit 70) according to a computer program stored on the memory 63, to perform the processing of these sections. Therefore, this computer program has code for controlling the sections to be controlled in order to execute the processing of these sections.

The printing process includes receiving a print command (S10), a paper supply operation (S20), a dot formation operation (S30), a carry operation (S40), a paper discharge determination (S50), a paper discharge operation (S60), and printing finished determination (S70). These operations are briefly described below.

Receiving the print command (S10) is a process for receiving a print command from the computer 110. In this process, the printer controller 60 receives the print command via the interface section 61.

The paper supply operation (S20) is an operation of moving the paper S to be printed to position it at a print start position (so-called "indexing position"). In this operation, the printer controller 60 drives the carry motor 22, for example, to rotate the paper supplying roller 21 and the carry roller 23.

The dot formation operation (S30) is an operation for forming dots on the paper S. In this operation, the printer controller 60 drives the carriage motor 31 and outputs the control signals to the drive signal generation circuit 70 and the head 41. Thus, ink is ejected from the nozzles Nz while the head 41 is moving, forming dots on the paper S.

The carry operation (S40) is an operation of moving the paper S in the carrying direction. In this operation, the printer controller 60 drives the carry motor 22 to rotate the carry roller 23. By this carry operation, dots can be formed at positions that are different from those dots formed in the previous dot formation operation.

The paper discharge determination (S50) is an operation of determining whether or not it is necessary to discharge the paper S that is being printed. This determination is made by the printer controller 60 based on whether or not there is print data, for example.

The paper discharge process (S60) is a process for discharging the paper S and is performed if the result of the preceding paper discharge determination is "discharge paper". In this case, the printer controller 60 causes the discharge roller 25 to rotate so that the paper S for which printing has finished is discharged to the outside.

The print over determination (S70) is a determination of whether or not to continue printing. This determination also is made by the printer controller 60.

===Method of Detecting the Amount of Ink===

<SUMMARY>

Figure 11:
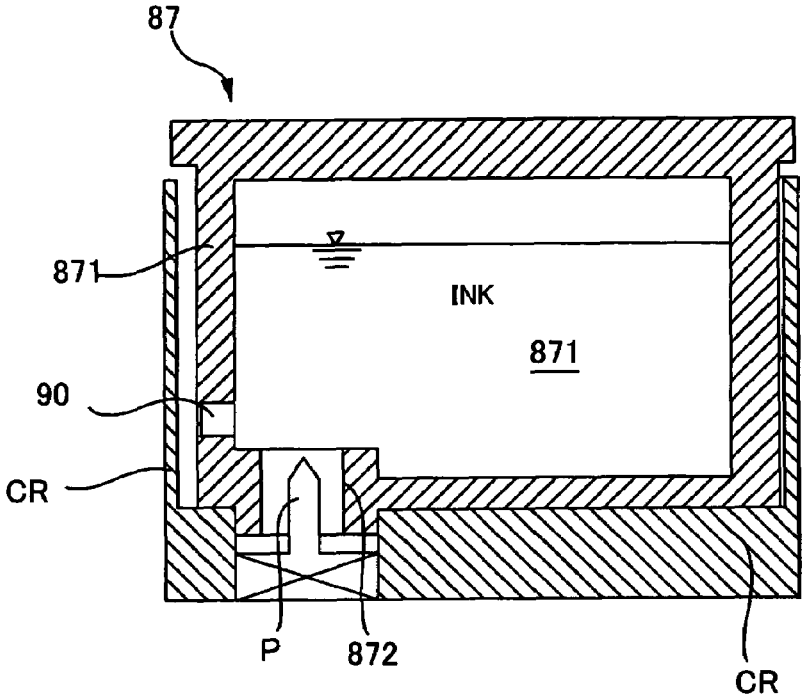
FIG. 11 is a cross-sectional view of a carriage and an ink cartridge.

FIG. 11 is a cross-sectional view of the carriage CR and the ink cartridge 87 mounted on the carriage CR.

The ink cartridge 87 is provided with an ink containing section 871 for containing ink inside thereof. Moreover, the cartridge 87 is provided with a supply section 872 for supplying ink. The carriage CR is provided with a needle P, and when the ink cartridge 87 is mounted on the carriage CR, the needle P sticks into the supply section 872, so that ink in the ink containing section 871 is supplied to the head 41 through the supply section 872.

When ink is consumed during printing, the amount of ink in the ink containing section 871 is reduced, and the liquid level of ink in the ink containing section 871 is lowered. Thus, in the present embodiment, a liquid level detection section 90 is provided at a predetermined position (referred to as "detection position") in the ink containing section 871. The liquid level detection section 90 detects whether or not ink is present at the detection position, so as to detect that the liquid level of ink in the ink containing section 871 has reached the detection position. Thus, the printer controller 60 can detect the amount of ink remaining in the ink containing section 871 based on the detection result from the liquid level detection section 90.

The printer controller 60 provides notification to the computer 110 when it is detected that the liquid level of ink in the ink containing section 871 has reached the detection position. The computer 110 displays the amount of ink remaining in the ink cartridge on the display device 120 based on the detection result. Naturally, the printer controller or the computer 110 may issue a warning to the user or may perform another operation, based on the detection result.

The ink amount detection process is performed when the printer 1 is powered on and when the ink cartridge 87 is changed. Moreover, it may be performed before or after a predetermined job. Furthermore, it is also possible that the printer 1 counts the number of times ink is ejected and the ink amount detection process is performed when the counted value has reached a predetermined value.

<The Configuration of the Liquid Level Detection Section 90>

Figure 12A:
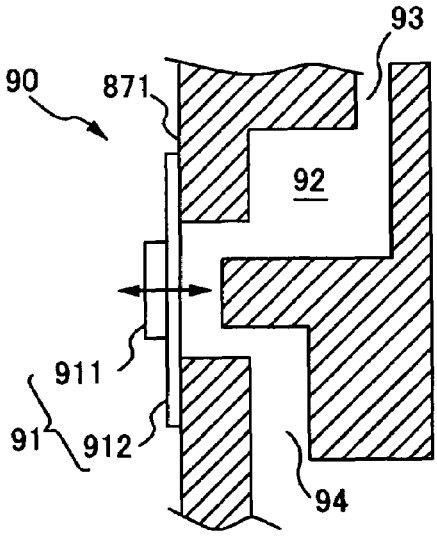
FIG. 12A is an explanatory diagram of a configuration of a liquid level detection section.
Figure 12B:
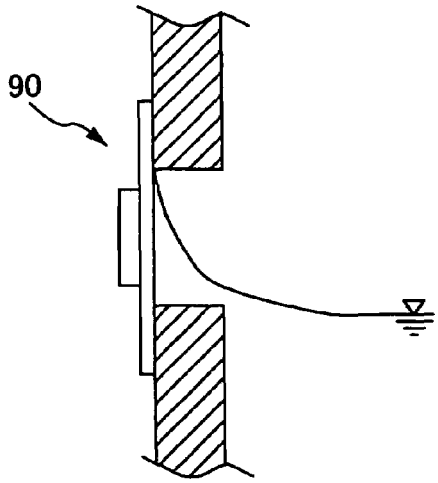
FIG. 12B is an explanatory diagram of an influence of the surface tension.

FIG. 12A is an explanatory diagram of a configuration of the liquid level detection section 90. The liquid level detection section 90 includes a vibration section 91, a buffer compartment 92, a first ink channel 93, and a second ink channel 94. The vibration section 91 has a piezo element 911 and a vibration plate 912. The buffer compartment 92 is an ink compartment for preventing vibration of ink near the vibration section 91 from being affected by the states of the ink containing section 871 and the first ink channel 93. The buffer compartment 92 and the ink containing section 871 are linked to each other via the first ink channel 93 and the second ink channel 94. When the liquid level in the ink containing section 81 is lowered and the liquid level in the ink containing section 81 is changed to a position lower than the vibration section 91, there is an inflow of air from the first ink channel 93, and the vibration section 91 is no longer in contact with ink. If the vibration section 91 is directly in contact with ink in the ink containing section 871, the vibration section 91 may remain in contact with ink by the influence of the surface tension even when the liquid level in the ink containing section 871 becomes lower than the vibration section 91 (see FIG. 12B). In the present embodiment, the capillary phenomenon due to the first ink channel 93 and the second ink channel 94 is utilized, so that the vibration section 91 comes out of contact with ink immediately when the liquid level in the ink containing section 871 becomes lower than the vibration section 91, and therefore the position of the liquid level in the ink containing section 871 can be detected correctly.

The piezo element 911 is provided on the vibration plate 912. The vibration plate 912 is provided on a side face of the cartridge 87 so as to close an opening of the cartridge 87. That is to say, the vibration plate 912 is provided with the piezo element 911 on one surface and is in contact with ink or air on the other surface. Whether the vibration plate 912 is in contact with ink or air changes depending on the height of the liquid level of ink in the ink containing section 871.

<The Configuration of the Vibration Section 91>

Figure 13A:
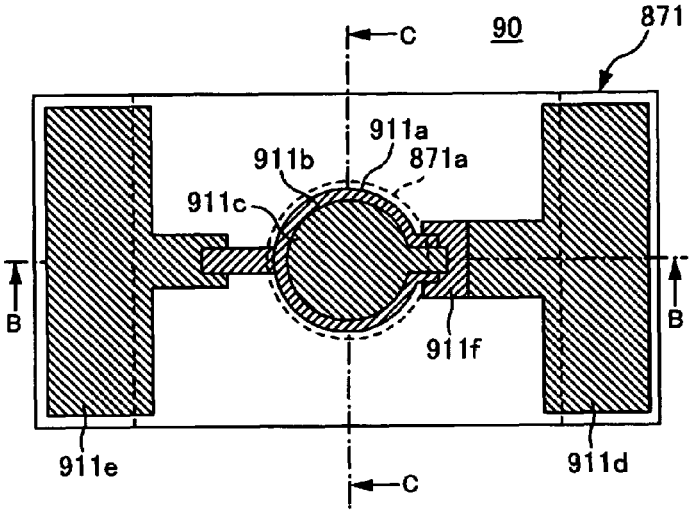
FIG. 13A is a plan view for explaining a detailed configuration of a vibration section.
Figure 13B:
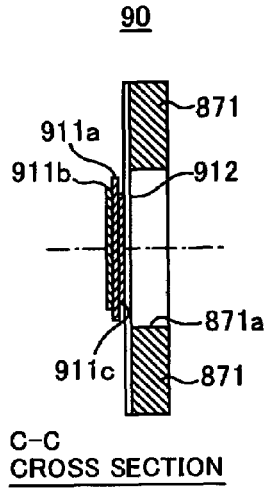
FIG. 13B is a cross-sectional view taken along the line B-B.
Figure 13C:
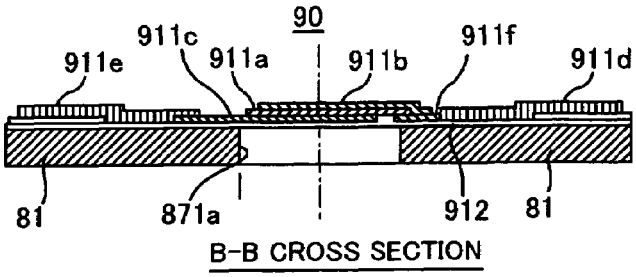
FIG. 13C is a cross-sectional view taken along the line C-C.

FIG. 13A is a plan view for explaining a detailed configuration of the vibration section. FIG. 13B is a cross-sectional view taken along the line B-B. FIG. 13C is a cross-sectional view taken along the line C-C.

The piezo element 911 is constituted by a piezoelectric layer 911*a*, an upper electrode 911*b*, and a lower electrode 911*c*. The main part of the piezoelectric layer 911*a*, the upper electrode 911*b*, and the lower electrode 911*c* has a circular shape. In this circular part, the piezoelectric layer 911*a* is sandwiched between the upper electrode 911*b* and the lower electrode 911*c*. The upper electrode 911*b* is electrically coupled to an upper electrode terminal 911*d*. Moreover, the lower electrode 911*c* is electrically coupled to a lower electrode terminal 911*e*. Furthermore, the lower electrode terminal 911*e* is formed on the surface of the vibration plate 912 so that it is electrically connected to the lower electrode 911*c*. On the other hand, the upper electrode terminal 911*d* is formed on the surface of the vibration plate 912 so that it is electrically connected to the upper electrode 911*b* via an auxiliary electrode 911*f*. Thus, a configuration in which the piezoelectric layer 911*a* and the upper electrode 911*b* are supported by the auxiliary electrode 911*f* is provided, and the mechanical strength can be improved.

The lower electrode 911*c* is positioned on the surface of the vibration plate 912 opposite to the opening 871*a* of the ink containing section 871. The center of the circular part of the lower electrode 911*c* substantially coincides with the center of the opening 871*a* of the ink containing section 871. It should be noted that the area of the circular part of the lower electrode 911*c* is smaller than the area of the opening 871*a*. On the other hand, the center of the circular part of the upper electrode 911*b* substantially coincides with the center of the opening 871*a* of the ink containing section 871. It should be noted that the area of the circular part of the upper electrode 911*b* is smaller than the area of the opening 871*a* and larger than the area of the circular part of the lower electrode 911*c*. The center of the circular part of the piezoelectric layer 911*a* substantially coincides with the center of the opening 871*a*. Moreover, the area of the circular part of the piezoelectric layer 911*a* is smaller than the area of the opening 871*a* and larger than the area of the circular part of the upper electrode 911*b* and the lower electrode 911*c*.

The center of the circular part of the piezoelectric layer 911*a*, the upper electrode 911*b*, and the lower electrode 911*c* constituting the piezo element 911 substantially coincides with the center of the opening 871*a*. On the other hand, a vibrating portion of the vibration plate 912 is determined by the opening 871*a*. Therefore, the center of the piezo element 911 substantially coincides with the center of the vibrating portion of the vibration plate 912. Thus, when the vibration plate 912 vibrates, the piezo element 911 can output a signal according to the resonance frequency of the vibration plate 912 with noise having little influence thereon.

It should be noted that in the present embodiment, lead zirconate titanate (PZT) is used for the piezoelectric layer 911*a*. However, this is not a limitation, and it is also possible to use lanthanum modified lead zirconate titanate (PLZT) or a lead-free piezoelectric film. In short, any material that provides the piezoelectric effect can be used.

<The Principle of the Liquid Level Detection>

When the drive signal is applied to the piezo element 911, the piezo element 911 expands and contracts, and the vibration plate 912 vibrates in the direction shown by an arrow in the drawing. Even when application of the drive signal to the piezo element 911 is stopped, a residual vibration occurs in the vibration plate 912. The properties of the residual vibration change significantly depending on whether or not the vibration plate 912 is in contact with ink. When the vibration plate 912 is in contact with ink, the frequency of the residual vibration is low, and the amplitude of the residual vibration is small. On the other hand, when the vibration plate 912 is not in contact with ink, the frequency of the residual vibration is high, and the amplitude of the residual vibration is large. When the vibration plate 912 vibrates because of the residual vibration, the piezo element 911 expands and contracts according to the residual vibration of the vibration plate 912, and outputs a signal. That is to say, when the vibration plate 912 is in contact with ink, the piezo element 911 outputs a signal having a low frequency and a small amplitude. On the other hand, when the vibration plate 912 is not in contact with ink, the piezo element 911 outputs a signal having a high frequency and a large amplitude. Thus, if the frequency of the signal output from the piezo element 911 can be detected, then whether or not the liquid level has reached the position of the vibration plate 912 can be detected, and therefore the amount of ink in the ink containing section 871 can be detected.

Figure 14:
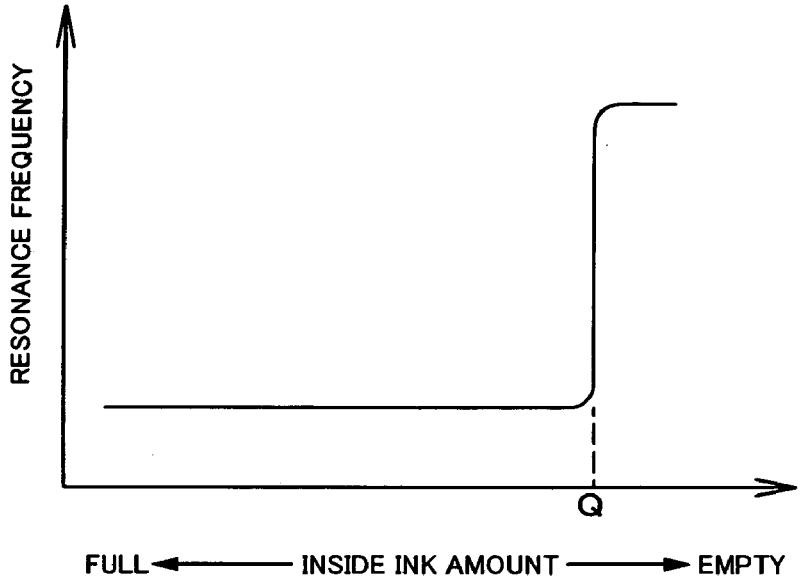
FIG. 14 is a graph showing a relationship between the amount of ink and the frequency of a residual vibration.

FIG. 14 is a graph showing a relationship between the amount of ink in the ink containing section 871 and the frequency of the residual vibration. Before the ink amount in the ink containing section 871 becomes Q, the liquid level of ink is at a position higher than the vibration plate 912 and the vibration plate 912 is in contact with ink, so that the frequency of the residual vibration is low. On the other hand, when the ink amount in the ink containing section 871 becomes Q, the liquid level of ink is at a position lower than the vibration plate 912 and the vibration plate 912 is no longer in contact with ink, so that the frequency of the residual vibration increases. Incidentally, since the capacity of the ink containing section 871 and the attaching position of the liquid level detection section 90 are fixed in design, the ink amount Q in the ink containing section 871 when the liquid level detection section 90 detects the liquid level also is a known value. Thus, when the frequency of the residual vibration changes from a low state to a high state, it is detected that the amount of ink remaining in the ink cartridge is the ink amount Q.

<The Configuration of the Signal Detection Section 95>

When the selection switch 65 (see FIG. 8) is connected to a terminal on the piezo element 911 side, the drive signal output from the drive signal generation circuit 70 is applied to the piezo element 911. Thus, the vibration plate 912 vibrates. Then, when the selection switch 65 is turned off, the piezo element 911 outputs a signal according to the residual vibration, and that signal is input to the signal detection section 95.

Figure 15:
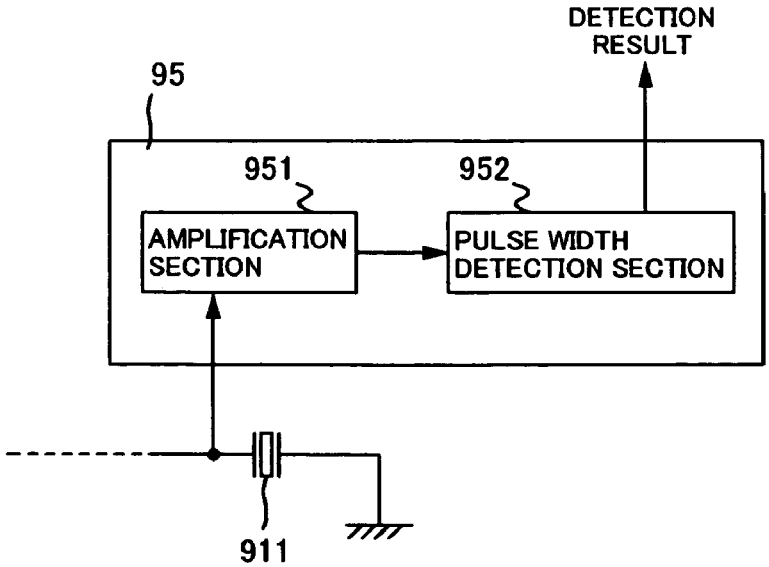
FIG. 15 is an explanatory diagram of a configuration of a signal detection section.

FIG. 15 is an explanatory diagram of a configuration of the signal detection section 95. The signal detection section 95 detects the cycle (or the frequency) of the signal output from the piezo element 911 and outputs the detection result to the printer controller 60. The signal detection section 95 has an amplification section 95 and a pulse width detection section 952.

Figure 16:
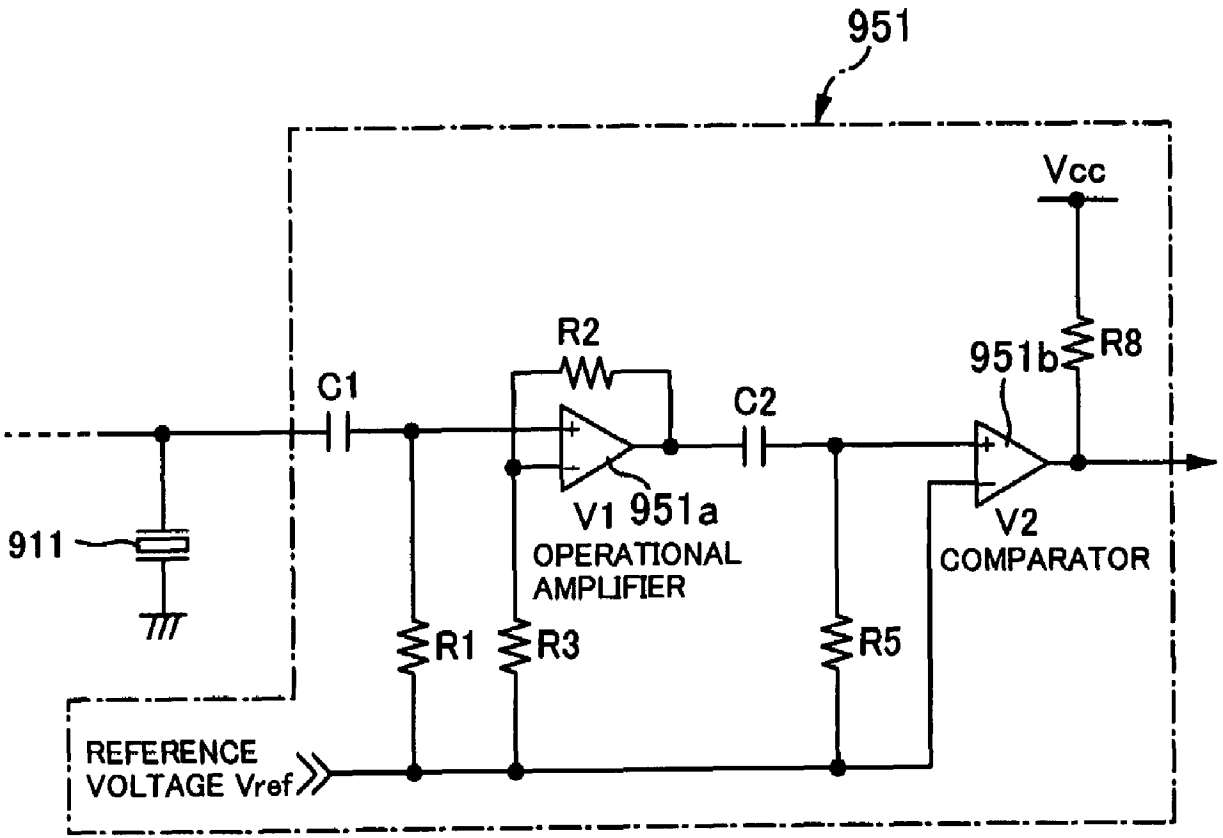
FIG. 16 is an explanatory diagram of a configuration of an amplification section.

FIG. 16 is an explanatory diagram of a configuration of the amplification section 951. In the amplification section 951, a low-frequency component contained in the signal from the piezo element 911 is eliminated by a high-pass filter constituted by a capacitor C1 and a resistor R1, and then amplification is performed by an operational amplifier 951*a*. Subsequently, an output of the operational amplifier 951*a* is passed through a high-pass filter constituted by a capacitor C2 and a resistor R2, thereby converting the output into a signal that oscillates above and below a reference voltage Vref, centering on the reference voltage Vref. Then, the signal is compared with the reference voltage Vref by a comparator 951*b* of the amplification section 951, and binarized depending on whether or not it is higher than the reference voltage.

Figure 17A:
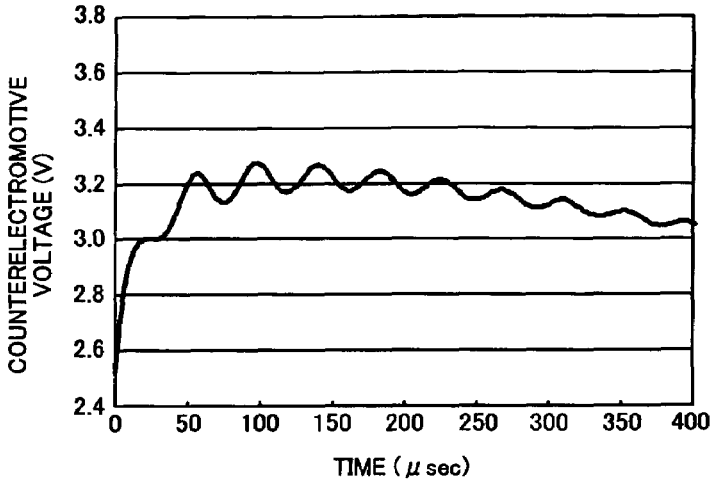
FIG. 17A is a diagram showing an output signal of a piezoelectric element.
Figure 17B:
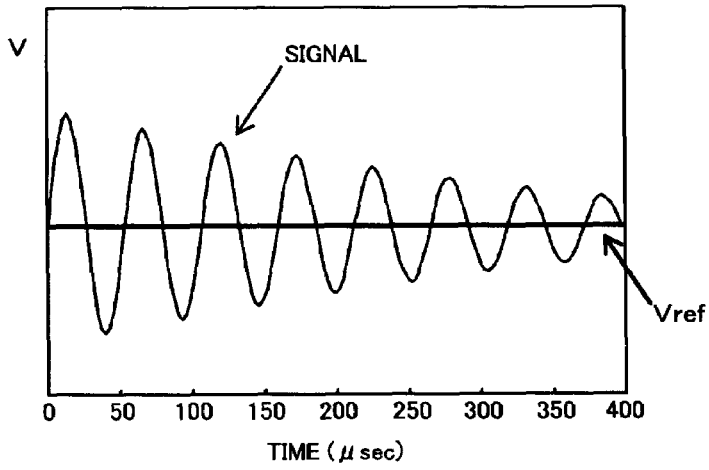
FIG. 17B is a diagram showing a reference signal Vref.
Figure 17C:
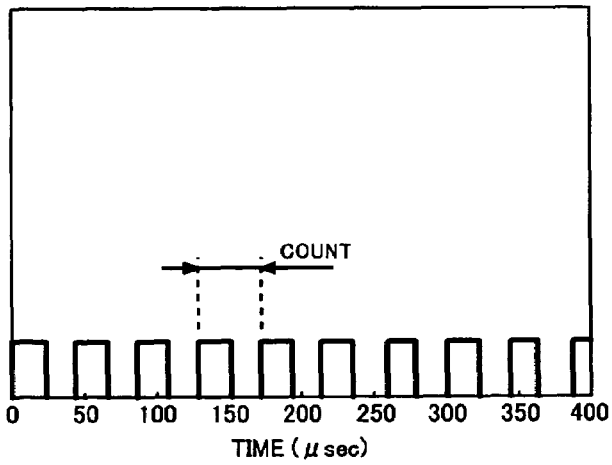
FIG. 17C is a diagram showing an output signal from a comparator.

FIG. 17A to FIG. 17C are explanatory diagrams of signals flowing through the signal detection section 96. FIG. 17A is a diagram showing a signal output by the piezo element 911 according to the residual vibration. FIG. 17B is a diagram showing a signal after the output of the operational amplifier 951*a* is passed through the high-pass filter constituted by the capacitor C2 and the resistor R2, and the reference voltage Vref. That is to say, a signal to be input to the comparator 951*b* is shown. FIG. 17C is a diagram showing an output signal from the comparator. That is to say, a signal to be input to the pulse width detection section 952 is shown.

When a pulse shown in FIG. 17C is input to the pulse width detection section 952, the pulse width detection section 952 resets the count value at the rising edge of the pulse, increments the count value for each clock signal thereafter, and outputs the count value at the rising edge of the next pulse to the printer controller 60. The printer controller 60 can detect the cycle of the signal output by the piezo element 911 based on the count value output by the pulse width detection section 952, i.e., based on the detection result output from the signal detection section 95.

<Drive Signal for Driving the Piezo Element 911 (Reference Examples)>

First, drive signals of two reference examples are described. In the present embodiment, the vibration plate 912 has a resonance frequency of 30 kHz (a cycle of 33.3 μs) when it is in contact with ink. Moreover, when not in contact with ink, it has a resonance frequency of 100 kHz (a cycle of 10 μs). If the vibration plate 912 undergoes the residual vibration at a particular resonance frequency as described above, then it is preferable to set the frequency of the drive signal to be applied to the piezo element 912 to the resonance frequency so that the residual vibration is excited.

Figure 18A:
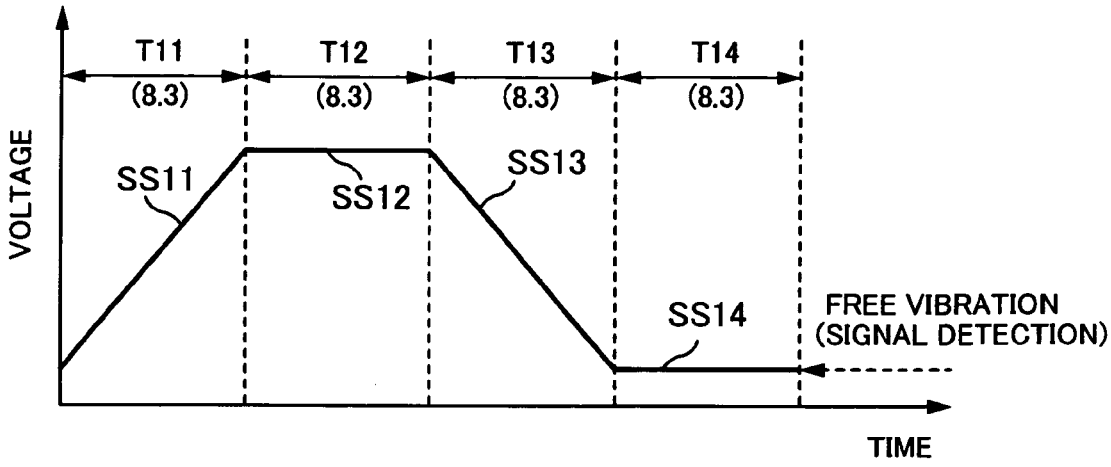
FIG. 18A is an explanatory diagram of a waveform of a first reference drive signal.
Figure 18B:
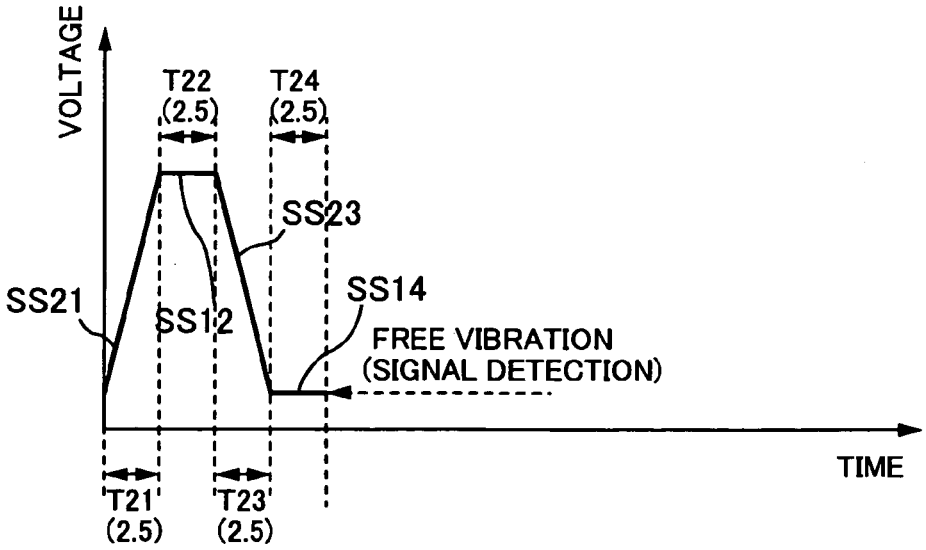
FIG. 18B is an explanatory diagram of a waveform of a second reference drive signal.

FIG. 18A is an explanatory diagram of a waveform of a drive signal (referred to as "first reference drive signal") tuned to the resonance frequency of 30 kHz when the vibration plate 912 is in contact with ink. FIG. 18B is an explanatory diagram of a waveform of a drive signal (referred to as "second reference drive signal") tuned to the resonance frequency of 100 kHz when the vibration plate 912 is not in contact with ink. What makes these drive signals different from each other is only the frequency, and thus the drive signal in FIG. 18A is described here.

The first reference drive signal has a first waveform portion SS11 generated in a period T11, a second waveform portion SS12 generated in a period T12, a third waveform portion SS13 generated in a period T13, and a third waveform portion SS14 generated in a period T14. The duration of each period is about 8.3 μs, and the duration of all of the periods is 33.3 μs (in the case of the second reference drive signal, the duration of each period is about 2.5 μs, and the duration of all of the periods is 10 μs).

When the first waveform portion SS11 is applied to the piezo element 911, the vibration plate 912 is displaced toward the inside of the ink containing section 871. That is to say, during the period T11, the vibration plate 912 continues to be displaced toward the inside of the ink containing section 871. When the second waveform portion SS12 is applied to the piezo element 911, the vibration plate 912 stops being displaced and comes into the hold state. When the third waveform portion SS13 is applied to the piezo element 911, the vibration plate 912 is displaced toward the outside of the ink containing section 871. That is to say, during the period T13, the vibration plate 912 continues to be displaced toward the outside of the ink containing section 871. When the fourth waveform portion SS14 is applied to the piezo element 911, the vibration plate 912 stops being displaced and comes into the hold state. After the period T14, the selection switch 65 is turned off, and the vibration plate 912 undergoes a residual vibration, and then a signal according to that residual vibration is output from the piezo element 911.

In the case where the first reference drive signal is applied to the piezo element 911, the vibration plate 912 is displaced during the period T11 and the period T13. When the first waveform portion SS11 or the third wave form portion SS13 is applied to the piezo element 911, the piezo element 911 is driven at the resonance frequency of the residual vibration when the vibration plate 912 is in contact with ink. Thus, when the first waveform portion SS11 and the third waveform portion SS13 are applied to the piezo element 912 when the vibration plate 912 is in contact with ink, the vibration plate 912 is displaced at the resonance frequency of the residual vibration, so that the residual vibration after the selection switch 65 is turned off is significantly excited.

Figure 19A:
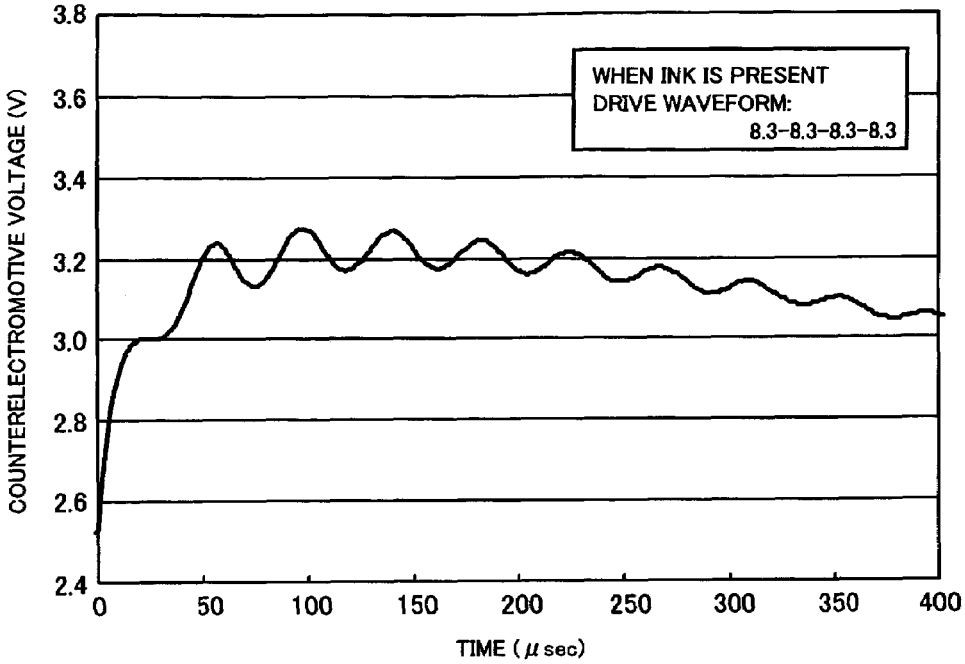
FIG. 19A shows an output signal of the piezo element after the first reference drive signal is applied to the piezo element when a vibration plate is in contact with ink.
Figure 19B:
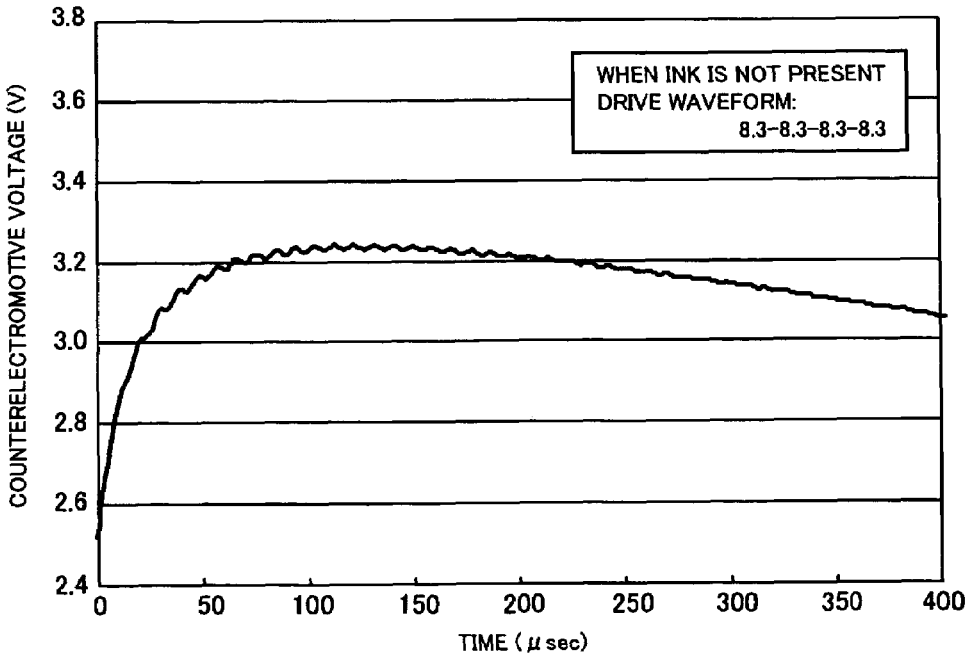
FIG. 19B shows an output signal of the piezo element after the first reference drive signal is applied to the piezo element when the vibration plate is not in contact with ink.

FIG. 19A and FIG. 19B show output signals of the piezo element 911 after the first reference drive signal is applied to the piezo element 911. In FIG. 19A, the vibration plate 912 is in contact with ink, whereas in FIG. 19B, the vibration plate 912 is not in contact with ink.

As shown in FIG. 19A, when the first reference drive signal is applied to the piezo element 911 while the vibration plate 912 is in contact with ink, the residual vibration is significantly excited, and thus the output signal of the piezo element 911 is increased. As a result, even when noise occurs in the binarized signal output by the comparator 951*b* of the signal detection section 95, the printer controller 60 can accurately detect the cycle of the signal output by the piezo element 911.

On the other hand, as shown in FIG. 19B, when the first reference drive signal is applied to the piezo element 911 while the vibration plate 912 is not in contact with ink, the signal output from the piezo element 911 is decreased. The reason for this is that since the resonance frequency of the residual vibration when the vibration plate 912 is not in contact with ink is 100 kHz, the residual vibration is hardly excited even when the first reference drive signal for driving the piezo element 911 at 33 kHz is applied. As a result, when noise occurs in the binarized signal output by the comparator 951*b* of the signal detection section 95, the printer controller 60 cannot correctly detect the cycle of the signal output by the piezo element 911.

Figure 20A:
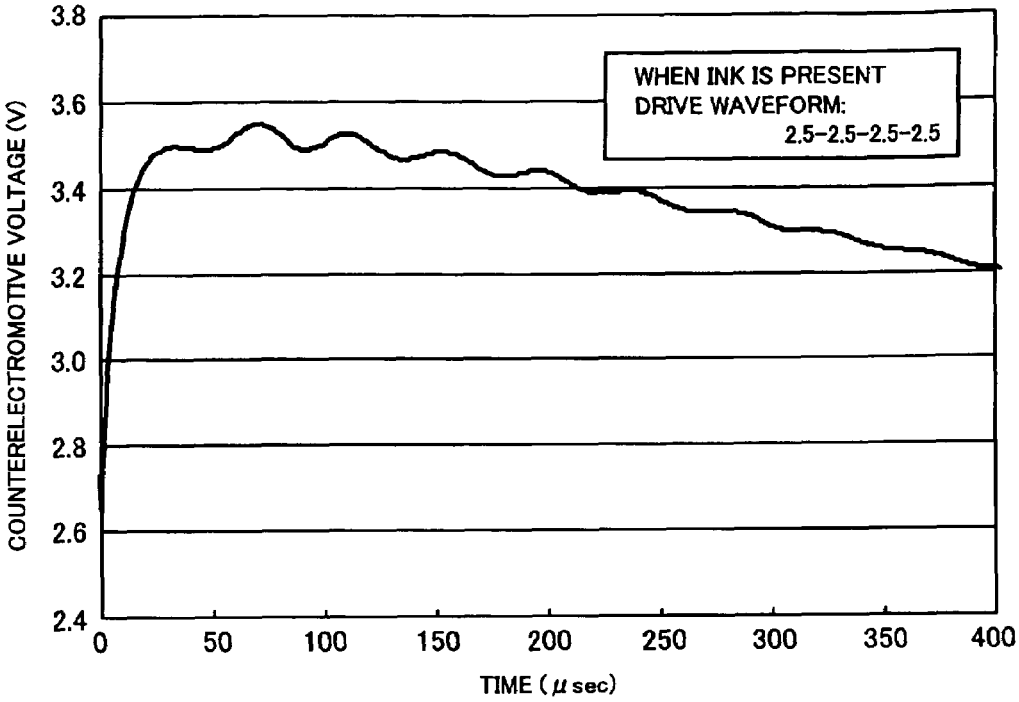
FIG. 20A shows an output signal of the piezo element after the second reference drive signal is applied to the piezo element when the vibration plate is in contact with ink.
Figure 20B:
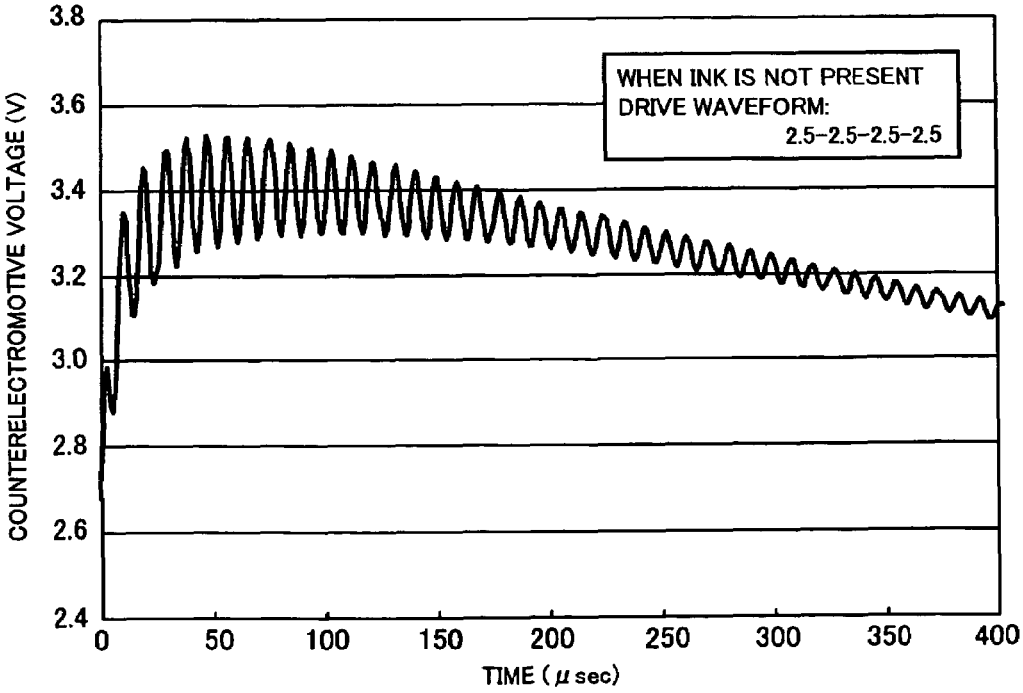
FIG. 20B shows an output signal of the piezo element after the second reference drive signal is applied to the piezo element when the vibration plate is not in contact with ink.

FIG. 20A and FIG. 20B show output signals of the piezo element when the second reference drive signal is applied to the piezo element 911. In FIG. 20A, the vibration plate 912 is in contact with ink, whereas in FIG. 20B, the vibration plate 912 is not in contact with ink.

In this case, a phenomenon opposite to that in the case of the first reference drive signal occurs. That is to say, when the vibration plate 912 is in contact with ink, the output signal of the piezo element 911 is decreased. On the other hand, when the vibration plate 912 is not in contact with ink, the output signal of the piezo element 911 is increased. In other words, when the vibration plate 912 is in contact with ink, the printer controller 60 cannot correctly detect the cycle of the signal output by the piezo element 911. On the other hand, when the vibration plate 912 is not in contact with ink, the printer controller 60 can accurately detect the cycle of the signal output by the piezo element 911.

Therefore, in order to detect that the vibration plate 912 is in contact with ink, the first reference drive signal is preferably applied to the piezo element 911. On the other hand, in order to detect that the vibration plate 912 is not in contact with ink, the second reference drive signal is preferably applied to the piezo element 911.

However, in detecting whether or not the vibration plate 912 is in contact with ink, it takes much time to first apply the first reference drive signal to the piezo element 911 to detect a residual vibration and then apply the second reference signal to the piezo element 911 to detect a residual vibration. But if the second reference drive signal is applied to the piezo element 911 immediately after the first reference drive signal is applied to the piezo element 911, then, when the vibration plate 912 is in contact with ink, the vibration of 30 kHz excited by the first reference drive signal is decreased during the application of the second reference drive signal.

Thus, in the present embodiment, a special drive signal is applied to the piezo element 911, this special drive signal being such that the residual vibration of the vibration plate 912 can be excited regardless of whether or not ink is present by simply applying a single drive signal.

<Drive Signal for Driving the Piezo Element 911 (Present Embodiment)>

Figure 21:
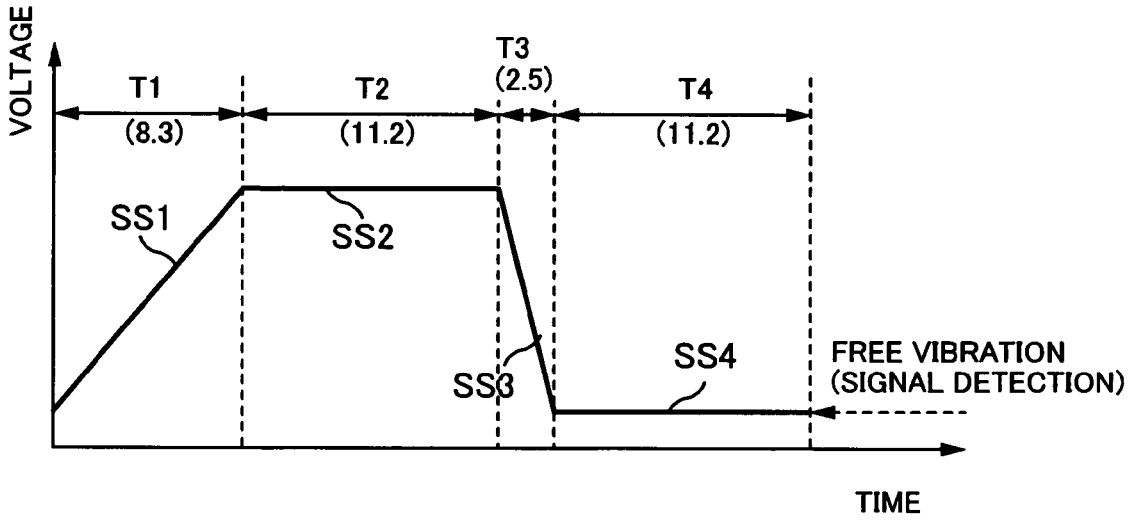
FIG. 21 is an explanatory diagram of a waveform of a drive signal of the present embodiment.

FIG. 21 is an explanatory diagram of a waveform of a drive signal of the present embodiment. This drive signal has a first waveform portion SS1 generated in a period T1, a second waveform portion SS2 generated in a period T2, a second waveform portion SS3 generated in a period T3, and a fourth waveform portion SS4 generated in a period T4. The period T1 has a duration of 8.3 μs (equal to that of the period T11 of the first reference drive signal), the period T2 has a duration of 11.2 μs, the period T3 has a duration of 2.5 μs (equal to that of a period T23 of the second reference drive signal), and the period T4 has a duration of 11.2 μs. The entire cycle of the drive signal of the present embodiment is 33.3 μs (equal to that of the first reference drive signal).

When the first waveform portion SS1 is applied to the piezo element 911, the vibration plate 912 is displaced toward the inside of the ink containing section 871. That is to say, during the period T11, the vibration plate 912 is displaced toward the inside of the ink containing section 871. If the vibration plate 912 is in contact with ink at this time, then a vibration of 30 kHz is excited. When the second waveform portion SS2 is applied to the piezo element 911, the vibration plate 912 stops being displaced and comes into the hold state. Then, the third waveform portion SS3 is applied to the piezo element. If the vibration plate 912 is not in contact with ink at this time, then a vibration of 100 kHz is excited. After the fourth waveform portion SS4 is applied to the piezo element 911, the selection switch 65 is turned off, and the vibration plate 912 undergoes a residual vibration, and then a signal according to that residual vibration is output from the piezo element.

Figure 22A:
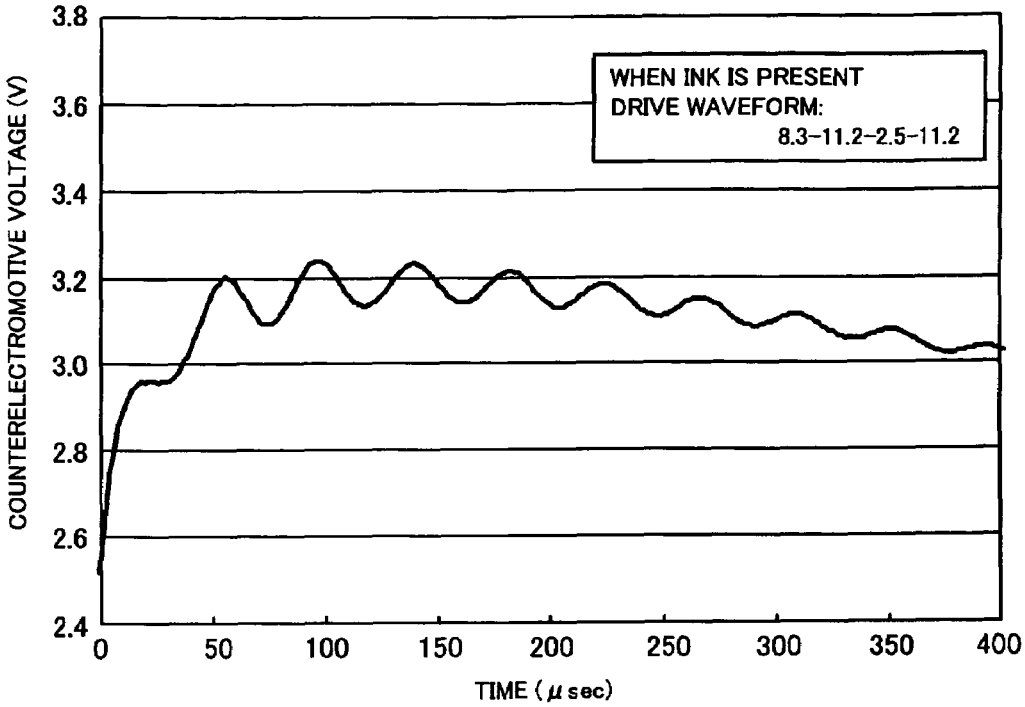
FIG. 22A shows an output signal of the piezo element after the drive signal of the present embodiment is applied to the piezo element when the vibration plate is in contact with ink.
Figure 22B:
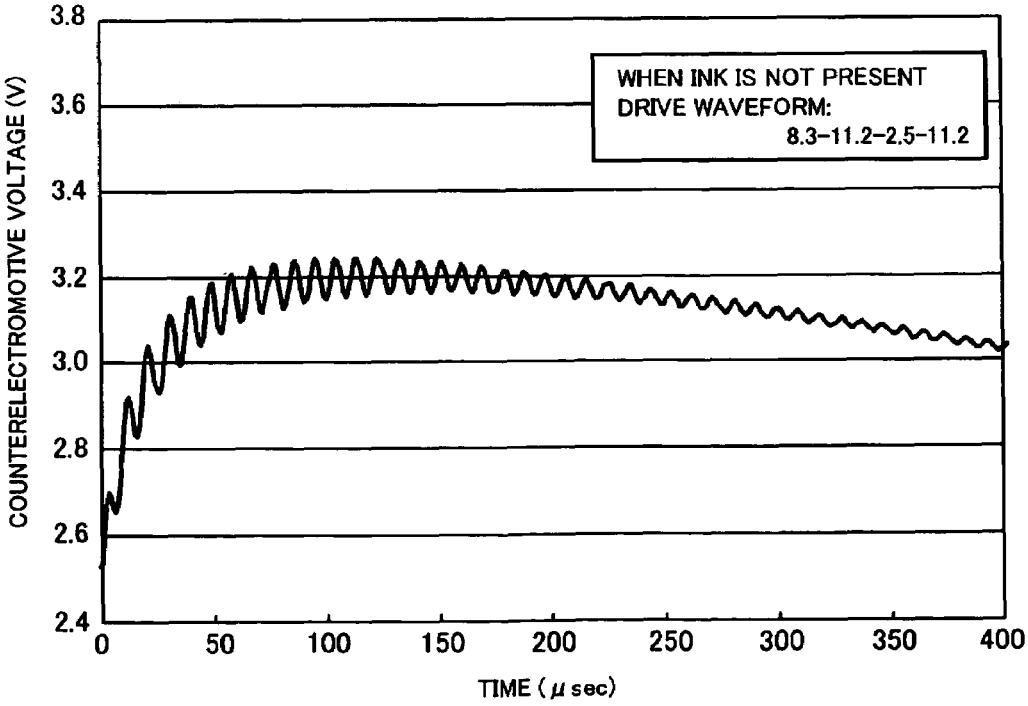
FIG. 22B shows an output signal of the piezo element after the drive signal of the present embodiment is applied to the piezo element when the vibration plate is not in contact with ink.

FIG. 22A and FIG. 22B show output signals of the piezo element 911 after the drive signal of the present embodiment is applied to the piezo element 911. In FIG. 22A, the vibration plate 912 is in contact with ink, whereas in FIG. 22B, the vibration plate 912 is not in contact with ink.

In the case where the vibration plate 912 is in contact with ink, a comparison between when the drive signal of the present embodiment is applied (see FIG. 22A) and when the first reference drive signal is applied (see FIG. 19A) shows that there is not much difference in magnitude of the output signal from the piezo element 911. Generally, a vibration having a low resonance frequency is less damped than a vibration having a high resonance frequency. Therefore, it is considered that even when the third wave form portion SS3 for exciting a vibration of 100 kHz was applied after the first waveform portion SS1 was applied and a vibration of 30 kHz was excited, damping of the vibration of 30 kHz was small. For this reason, when the drive signal of the present embodiment is applied to the piezo element 911, the printer controller 60 can accurately detect the cycle of the signal output by the piezo element 911.

Moreover, in the case where the vibration plate 912 is in contact with ink, a comparison between when the drive signal of the present embodiment is applied (see FIG. 22A) and when the second reference drive signal is applied (see FIG. 20A) shows that the magnitude of the output signal from the piezo element 911 in the present embodiment is greater. This means that a residual vibration of 30 kHz is excited by applying the drive signal of the present embodiment to the piezo element 911. For this reason, when the drive signal of the present embodiment is applied to the piezo element 911, the printer controller 60 can accurately detect the cycle of the signal output by the piezo element 911 even when noise occurs in the binarized signal output by the comparator 951*b* of the signal detection section 95.

In the case where the vibration plate 912 is not in contact with ink, a comparison between when the drive signal of the present embodiment is applied (see FIG. 22B) and when the first reference drive signal is applied (see FIG. 20B) shows that the magnitude of the output signal from the piezo element 911 in the present embodiment is greater. The reason for this is that when the first reference drive signal is applied, a vibration of 100 kHz is hardly excited. When the drive signal of the present embodiment is applied, a vibration of 100 kHz is excited by the third waveform portion SS3. Thus, when the drive signal of the present embodiment is applied to the piezo element 911, the printer controller 60 can accurately detect the cycle of the signal output by the piezo element 911 even when noise occurs in the binarized signal output by the comparator 951*b* of the signal detection section 95.

In the case where the vibration plate 912 is not in contact with ink, a comparison between when the drive signal of the present embodiment is applied (see FIG. 22B) and when the second reference drive signal is applied (see FIG. 20B) shows that the magnitude of the output signal from the piezo element 911 in the present embodiment is slightly smaller. The reason for this is that in the case of the second reference drive signal, a vibration of 100 kHz is excited by the two waveform portions, i.e., the first waveform portion SS21 and the third waveform portion SS23, whereas in the case of the present embodiment, a vibration of 100 kHz is excited by the third waveform portion SS3 alone. However, in the case where the vibration plate 912 is not in contact with ink, the vibration plate 912 is easily displaced when the piezo element 911 is driven, so that a sufficient amplitude for the detection of the residual vibration can be obtained even when the vibration is excited by the third waveform portion alone as in the present embodiment. Moreover, in the case of the second reference drive signal, the vibration of 100 kHz is hardly damped because the hold time of a period T24 corresponds to ¼ of the vibration cycle of 100 kHz, whereas in the present embodiment, the energy of the vibration of 100 kHz is reduced because the hold time of the period T4 is not matched with the vibration cycle of 100 kHz. However, even in the case of the present embodiment, the influence of damping of the vibration is small because the detection of the residual vibration is started relatively quickly after the vibration of 100 kHz is excited, so that a sufficient amplitude for the detection of the residual vibration can be obtained.

As shown in FIG. 22A and FIG. 22B, when the drive signal of the present embodiment is applied to the piezo element 911, a sufficient amplitude for the detection of the residual vibration can be obtained regardless of whether or not the vibration plate 912 is in contact with ink. Thus, whether or not ink is present can be detected by simply applying the drive signal once, so that the detection time can be reduced.

<Drive Signal for Driving the Piezo Element 911 (Modified Example of the Present Embodiment)>

Figure 23:
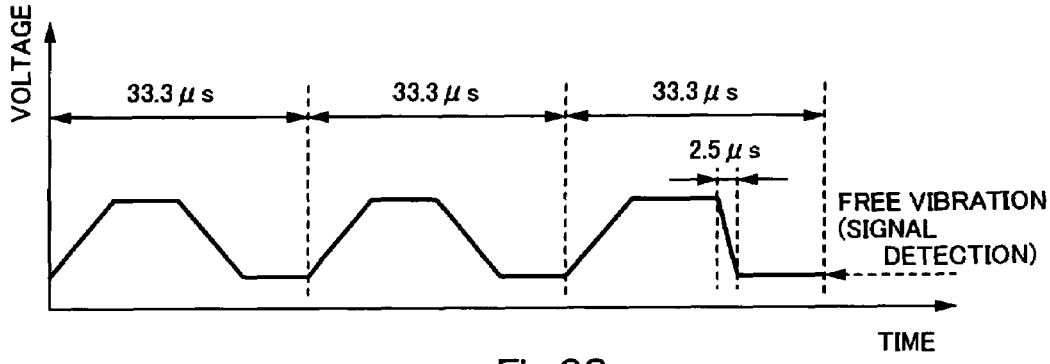
FIG. 23 is an explanatory diagram of a modified example of the waveform of the drive signal of the present embodiment.

FIG. 23 is an explanatory diagram of a modified example of the waveform of the drive signal of the present embodiment. In this modified example, the above-described first reference drive signal is first applied to the piezo element 911 twice in succession, and immediately thereafter the drive signal of the above-described embodiment is applied to the piezo element 911. That is to say, in the modified example, the waveform portion (the first waveform portion SS11 or the third waveform portion SS13 in FIG. 18A or the first waveform portion SS1 in FIG. 21) for exciting a vibration of 30 kHz is applied to the piezo element 911 five times in succession, and thereafter the waveform portion (the third waveform portion S3 in FIG. 21) for exciting a vibration of 100 kHz is applied.

When the vibration plate 912 is in contact with ink, in order to increase the amplitude of the residual vibration, it is necessary to significantly displace the vibration plate 912 before then. Thus, in this modified example, the piezo element 911 is driven repeatedly at 30 kHz (a frequency equal to the resonance frequency of the residual vibration when the vibration plate 912 is in contact with ink). For this reason, if the vibration plate 912 is in contact with ink, the vibration plate 912 has been significantly displaced after the first reference drive signal is applied twice in succession. Once a vibration of 30 kHz is significantly excited, it is less damped than a vibration of 100 kHz, so that even when the third waveform portion SS3 (see FIG. 21) for exciting a vibration of 100 kHz is applied thereafter, damping of the vibration of 30 kHz is small. Thus, when the drive signal of this modified example is applied to the piezo element 911, the residual vibration of 30 kHz can be detected more accurately than in the above-described embodiment.

Moreover, in the case where the vibration plate 912 is not in contact with ink, the vibration plate 912 is easily displaced when the piezo element 911 is driven, so that a sufficient amplitude for the detection of the residual vibration can be obtained by simply applying the third waveform portion SS3 in FIG. 21 to the piezo element 911 once.

Figure 24:
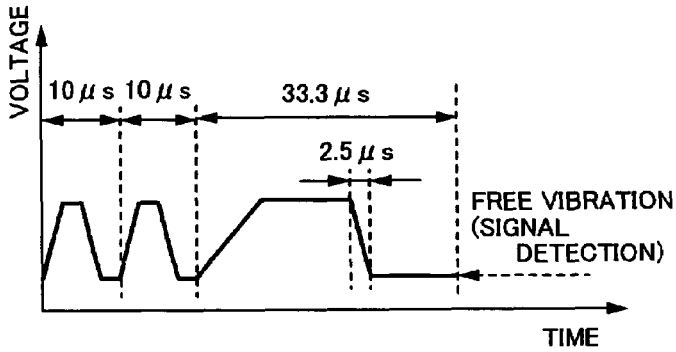
FIG. 24 is an explanatory diagram of a drive signal of a comparative example.

Incidentally, FIG. 24 is an explanatory diagram of a drive signal of a comparative example. In this comparative example, the above-described second reference drive signal is first applied to the piezo element 911 twice in succession, and immediately thereafter the drive signal of the above-described embodiment is applied to the piezo element 911. In this case, since the piezo element 911 is initially driven repeatedly at 100 kHz, the vibration plate 912 is in a significantly displaced state when the vibration plate 912 is not in contact with ink.

However, since a vibration of 100 kHz is damped more easily than a vibration of 30 kHz, when the first waveform portion SS1 for exciting a vibration of 30 kHz is applied thereafter, the amplitude is damped rapidly. As a result, in the comparative example, an additional detection time is required even though the accuracy of the detection of the residual vibration of 100 kHz is not much different from that in the above-described embodiment. Thus, it is more advantageous to apply the drive signal of the above-described embodiment to the piezo element 911 than to apply the drive signal of this comparative example to the piezo element 911.

OTHER EMBODIMENTS

The foregoing embodiment primarily describes the printing system 100 that includes the printer 1, but it also includes the disclosure of methods of applying the drive signal and liquid ejection systems, for example. Moreover, the foregoing embodiment is for the purpose of elucidating the present invention, and is not to be interpreted as limiting the present invention. It goes without saying that the present invention can be altered and improved without departing from the gist thereof and includes functional equivalents. In particular, embodiments mentioned below are also included in the present invention.

<Regarding the Ink>

Since the above-described embodiment was described using the printer 1, dye ink or pigment ink in liquid form was ejected from the nozzles Nz. However, the liquid that is ejected from the nozzles Nz is not limited to such inks as long as it is in liquid form.

<Regarding Other Applications>

Moreover, although the printer 1 was described in the above-described embodiment, the present invention is not limited to this. For example, the same technology as that of the present embodiment can also be applied to various types of liquid ejection apparatuses that employ inkjet technology, including color filter manufacturing apparatuses, dyeing apparatuses, fine processing apparatuses, semiconductor manufacturing apparatuses, surface processing apparatuses, three-dimensional shape forming machines, liquid vaporizing apparatuses, organic EL manufacturing apparatuses (in particular, macromolecular EL manufacturing apparatuses), display manufacturing apparatuses, film formation apparatuses, and DNA chip manufacturing apparatuses. Moreover, methods and manufacturing methods of these are also within the scope of application.

===Overview===

(1) In the above-described embodiment, the ink cartridge 87 is provided with the ink containing section 871 for containing ink. The ink containing section 871 is provided with the opening 871*a*, and the piezo element 911 (an example of the piezoelectric element) of the vibration section 91 of the liquid level detection section 90 is provided at the position of the opening 871*a* (see FIG. 11 and FIG. 12A).

When ink is present at the attaching position of the piezo element 91 (when the vibration plate 912 is in contact with ink), the resonance frequency of the residual vibration is 30 kHz. Moreover, when ink is not present at the attaching position of the piezo element 911 (when the vibration plate 912 is not in contact with ink), the resonance frequency of the residual vibration is 100 kHz. Thus, by applying the drive signal to the piezo element 911 and detecting the output signal from the piezo element 911 due to the residual vibration after the application of the drive signal, the printer controller 60 can detect whether or not ink is present at the attaching position of the piezo element 911 based on the frequency of the output signal of the piezo element 911. At the time when the detection result changes from a state indicating the presence of ink to a state indicating the absence of ink, it is detected that the liquid level of ink has reached the height of the attaching position of the piezo element 911, so that the amount of ink in the ink containing section 871 can be detected.

Here, if the first reference drive signal (see FIG. 18A) is applied to the piezo element, then a residual vibration of 30 kHz can be excited. However, when ink is not present at the attaching position of the piezo element 911, the residual vibration is hardly excited even when the first reference drive signal is applied to the piezo element 911 (see FIG. 19B). Similarly, when ink is present at the attaching position of the piezo element 911, the residual vibration is hardly excited even when the second reference drive signal (see FIG. 18B) is applied to the piezo element 911 (see FIG. 20A). Thus, there is a possibility of misdetection because the residual vibration may not be excited by simply applying one of those drive signals alone to the piezo element 911.

However, in detecting whether or not ink is present at the attaching position of the piezo element 911, the detection takes much time when the first reference drive signal is first applied to the piezo element 911 to detect a residual vibration and then the second reference drive signal is applied to the piezo element 911 to detect a residual vibration.

Therefore, in the present embodiment, the drive waveform generation circuit 70 (see FIG. 2) generates the drive signal (see FIG. 21) containing the first waveform portion SS1 (see FIG. 21, an example of the first drive waveform portion) for exciting a residual vibration of 30 kHz and the third waveform portion SS3 (see FIG. 21, an example of the second drive waveform portion) for exciting a residual vibration of 100 kHz, and this drive signal is applied to the piezo element 911. Thus, a sufficient residual vibration for the detection can be excited regardless of whether or not ink is present at the attaching position of the piezo element 911.

(2) In the above-described embodiment, the first waveform portion SS1 for exciting a low resonance frequency is applied to the piezo element 911 before the third waveform portion SS3 (see FIG. 21). This is because a vibration having a low frequency has a property of becoming resistant to damping once it is excited. However, the drive waveform portion for exciting a vibration of 100 kHz may be applied to the piezo element 911 first, as long as a sufficient amplitude is provided even after damping.

(3) In the above-described embodiment, the first reference drive signal is applied to the piezo element 911 twice in succession, and furthermore the first waveform portion SS1 is applied to the piezo element 911, and thereafter the third waveform portion SS3 is applied to the piezo element 911 (see FIG. 23). The reason for this is that although a vibration having a high frequency can achieve a sufficient amplitude with a small amount of energy, a vibration having a low frequency requires a large amount of energy before it achieves a sufficient amplitude.

(4) In the above-described embodiment, the first waveform portion SS1 (see FIG. 21, an example of the first drive waveform portion) for exciting a residual vibration when ink is present is applied to the piezo element 911, and thereafter the third waveform portion SS3 (see FIG. 21, an example of the second drive waveform portion) for exciting a residual vibration when ink is not present is applied to the piezo element 911. This is because the residual vibration when ink is present has a property of being more resistant to damping than the residual vibration when ink is not present.

(5) In the above-described embodiment, the first reference drive signal for exciting a residual vibration when ink is present is applied to the piezo element 911 twice in succession, and furthermore the first waveform portion SS1 is applied to the piezo element 911, and thereafter the third waveform portion SS3 for exciting a residual vibration when ink is not present is applied to the piezo element 911. This is because the residual vibration when ink is present requires a large amount of energy to achieve a sufficient amplitude.

(6) In the above-described embodiment, the first waveform portion SS1 (an example of the first drive waveform portion) and the third waveform portion SS3 (an example of the second drive waveform portion) drive the piezo element for a duration corresponding to the resonance frequency of the residual vibration. This is the reason why the first waveform portion SS1 can excite a residual vibration of 30 kHz and the third waveform portion SS3 can excite a residual vibration of 100 kHz.

(7) In the above-described embodiment, the first waveform portion SS1 is a signal that drives the piezoelectric element for a duration of 8.3 μs, which corresponds to ¼ of the cycle (33.3 μs) of the residual vibration of 30 kHz. Thus, the first waveform portion SS1 can excite a residual vibration of 30 kHz.

(8) In the above-described embodiment, the third waveform portion SS3 is a signal that drives the piezoelectric element for a duration of 2.5 μs, which corresponds to ¼ of the cycle (10.0 μs) of the residual vibration of 100 kHz. Thus, the third waveform portion SS3 can excite a residual vibration of 100 kHz.

However, the first waveform portion SS1 and the third waveform portion SS3 are not limited to those that drive the piezoelectric element only for a duration corresponding to ¼ of the cycle of the residual vibration. Moreover, although the above-described drive signal is a trapezoidal wave, the present invention is not limited to this.

Figure 25:
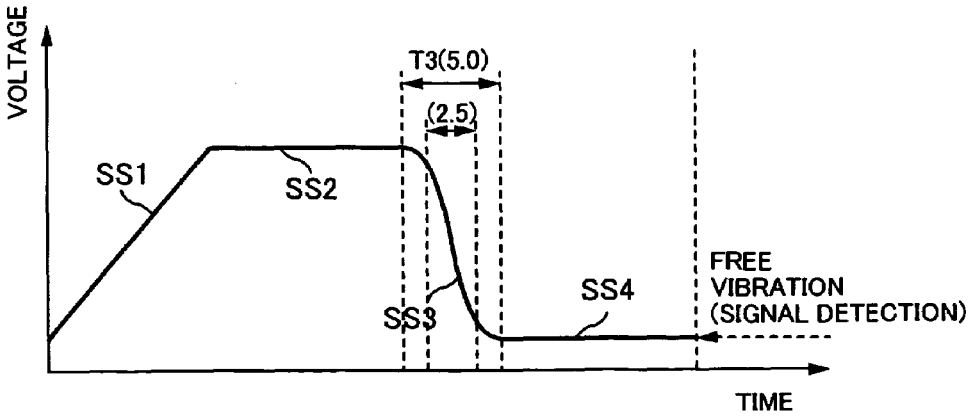
FIG. 25 is an explanatory diagram of another example of a third waveform portion SS3.

For example, FIG. 25 shows another example of the third waveform portion SS3. The first waveform portion SS1 in the drawing is the same as described above, and the second waveform portion SS2 and the fourth waveform portion SS4 have slightly shorter durations than those described above. The third waveform portion SS3 in this example drives the piezoelectric element for a duration that corresponds to ½ of the residual vibration. Moreover, this third waveform portion SS3 is a sine wave. Such a drive signal can also excite a residual vibration of 100 kHz.

(9) In the above-described embodiment, the drive signal generation circuit 70 generates the ejection drive signal COM. Then, the piezo element 417 (an example of the drive element) is driven by the ejection drive signal COM, so that an ink droplet is ejected from the nozzle. Moreover, in the above-described embodiment, the drive signal generation circuit 70 for generating the ejection drive signal generates the drive signal containing the first waveform portion SS1 and the third waveform portion SS3 (see FIG. 21). Then, the piezo element 911 is driven by this drive signal.

That is to say, in the above-described embodiment, the drive signal generation circuit 70 generates the drive signal for ejecting ink and the drive signal for detecting the amount of ink. Thus, it is not necessary to provide two different types of drive signal generation circuits, and therefore the configuration of the apparatus can be simplified.

(10) In the above-described embodiment, a signal generated by the drive signal generation circuit 70 is applied to either the piezo element 417 (an example of the drive element) or the piezo element 911 (an example of the piezoelectric element) by switching the selection switch 65 (see FIG. 8).

(11) However, the present invention is not limited to the configuration in which the drive signal generated by the drive signal generation circuit 70 is applied only to either the piezo element 417 or the piezo element 911 as in the above-described embodiment. For example, if pixel data corresponding to all of the nozzles is set to "00", then a drive signal may be applied to the switches 85 when that drive signal is applied to the piezo element 911 (an example of the piezoelectric element). That is to say, the selection switch 65 is not required to disconnect application of the drive signal to the piezo element 417 (an example of the drive element) when the drive signal is applied to the piezo element 911.

(12) In the above-described embodiment, the control circuit of the head is operated by a power source of 5 V that is not shown. Even if the piezo element 911 is driven by this power source of 5 V, a sufficient residual vibration for the detection cannot be excited because of the low voltage.

On the other hand, the drive signal generation circuit 70 is required to generate a drive signal that involves a large voltage change because it is necessary to drive the piezo element 417 so that an ink droplet is ejected. In the above-described embodiment, since the drive signal generated by the drive signal generation circuit 70 is applied to the piezo element 911, the piezo element 911 can be expanded and contracted significantly, and thus a sufficient residual vibration for the detection can be excited.

(13) In the above-described embodiment, the buffer compartment 92 (see FIG. 12A) is provided. Thus, even when ink in the ink containing section vibrates, the influence of that vibration can be prevented from being transmitted to the vibration plate 912. Thus, the piezo element 911 can accurately detect the resonance frequency of the vibration plate 912.

(14) In the above-described embodiment, the opening 871*a* of the ink containing section 871 is closed by the vibration plate 912. For this reason, a portion within the area of the opening 871*a* of the vibration plate 912 vibrates. Moreover, the center of the piezo element 911 substantially coincides with the center of the opening 871*a*. Thus, the piezo element 911 can accurately detect the resonance frequency of the vibration plate 912.

(15) In the above-described embodiment, the amount of remaining ink contained in the ink cartridge for use in the printer is detected. However, the liquid to be detected is not limited to ink.

For example, when the present method of detecting the liquid amount is applied to semiconductor manufacturing apparatuses, such as those for forming circuits on semiconductors by ejecting a liquid, the liquid amount of the processing liquid can be detected. In this manner, the present embodiment can be applied widely to liquid amount detection methods in which the liquid amount of a liquid contained in a liquid containing section is detected using a piezoelectric element.

That is claimed is:

1. A method of detecting a liquid amount, comprising:

applying a drive signal to a piezoelectric element provided at a predetermined position in a liquid containing section for containing a liquid;

detecting an output signal from the piezoelectric element due to a residual vibration after the application of the drive signal; and detecting whether or not the liquid is present at the predetermined position based on the output signal utilizing a difference in resonance frequency of the residual vibration depending on whether or not the liquid is present at the predetermined position, wherein the drive signal includes a first drive waveform portion for driving the piezoelectric element at a resonance frequency of the residual vibration when the liquid is present at the predetermined position and a second drive waveform portion for driving the piezoelectric element at a resonance frequency of the residual vibration when the liquid is not present at the predetermined position.

2. A method of detecting a liquid amount according to claim 1, wherein of the first drive waveform portion and the second drive waveform portion, the waveform portion having the lower resonance frequency is applied first to the piezoelectric element.

3. A method of detecting a liquid amount according to claim 2, wherein the waveform portion having the lower resonance frequency is applied to the piezoelectric element a plurality of times in succession, and thereafter the waveform portion having the higher resonance frequency is applied to the piezoelectric element.

4. A method of detecting a liquid amount according to claim 1, wherein the first drive waveform portion is applied to the piezoelectric element, and thereafter the second drive waveform portion is applied to the piezoelectric element.

5. A method of detecting a liquid amount according to claim 4, wherein the first drive waveform portion is applied to the piezoelectric element a plurality of times in succession, and thereafter the second drive waveform portion is applied to the piezoelectric element.

6. A method of detecting a liquid amount according to claim 1, wherein the first drive waveform portion and the second drive waveform portion drive the piezoelectric element for a duration corresponding to the resonance frequency of the residual vibration.

7. A method of detecting a liquid amount according to claim 6, wherein the first drive waveform portion is a signal that drives the piezoelectric element for a duration corresponding to ¼ of a cycle of the residual vibration when the liquid is present at the predetermined position.

8. A method of detecting a liquid amount according to claim 6, wherein the second drive waveform portion is a signal that drives the piezoelectric element for a duration corresponding to ¼ of a cycle of the residual vibration when the liquid is not present at the predetermined position.

9. A method of detecting a liquid amount according to claim 1, wherein a drive signal generation section generates an ejection drive signal for ejecting the liquid contained in the liquid containing section, a drive element that is different from the piezoelectric element is driven by the ejection drive signal so that the liquid is ejected from a nozzle, the drive signal generation section generates the drive signal including the first drive waveform portion and the second drive waveform portion, and the piezoelectric element is driven by the drive signal.

10. A method of detecting a liquid amount according to claim 9, wherein a signal generated by the drive signal generation section is applied to either one of the drive element and the piezoelectric element by switching a switch.

11. A method of detecting a liquid amount according to claim 9, wherein a switch for applying a signal generated by the drive signal generation section to the piezoelectric element is provided.

12. A method of detecting a liquid amount according to claim 9, wherein a voltage of the drive signal is higher than a voltage of a power source for operating a control circuit of a head for ejecting the liquid.

13. A method of detecting a liquid amount according to claim 1, wherein a buffer compartment for preventing the piezoelectric element from being affected by a state of the liquid in the liquid containing section is provided near the predetermined position.

14. A method of detecting a liquid amount according to claim 1, wherein the liquid containing section is provided with an opening, the opening is closed by a vibration plate, the vibration plate is provided with the piezoelectric element, and the center of the opening coincides with the center of the piezoelectric element.

15. A method of detecting a liquid amount according to claim 1, wherein the liquid is ink.

16. A method of detecting a liquid amount, comprising:

applying a drive signal to a piezoelectric element provided at a predetermined position in a liquid containing section for containing a liquid;

detecting an output signal from the piezoelectric element due to a residual vibration after the application of the drive signal; and detecting whether or not the liquid is present at the predetermined position based on the output signal utilizing difference in resonance frequency of the residual vibration depending on whether or not the liquid is present at the predetermined position, wherein the drive signal comprises a first drive waveform portion for driving the piezoelectric element at a resonance frequency of the residual vibration when the liquid is present at the predetermined position and a second drive waveform portion for driving the piezoelectric element at a resonance frequency of the residual vibration when the liquid is not present at the predetermined position, the first drive waveform portion is applied to the piezoelectric element a plurality of times in succession, and thereafter the second drive waveform portion is applied to the piezoelectric element, the first drive waveform portion is a signal that drives the piezoelectric element for a duration corresponding to ¼ of a cycle of the residual vibration when the liquid is present at the predetermined position, the second drive waveform portion is a signal that drives the piezoelectric element for a duration corresponding to ¼ of a cycle of the residual vibration when the liquid is not present at the predetermined position, a drive signal generation section generates an ejection drive signal for ejecting the liquid contained in the liquid containing section, a drive element that is different from the piezoelectric element is driven by the ejection drive signal so that the liquid is ejected from a nozzle, the drive signal generation section generates the drive signal comprising the first drive waveform portion and the second drive waveform portion, the piezoelectric element is driven by the drive signal, a signal generated by the drive signal generation section is applied to either one of the drive element and the piezoelectric element by switching a switch, a voltage of the drive signal is higher than a voltage of a power source for operating a control circuit of a head for ejecting the liquid, a buffer compartment for preventing the piezoelectric element from being affected by a vibration of the liquid in the liquid containing section is provided near the predetermined position, the liquid containing section is provided with an opening, the opening is closed by a vibration plate, the vibration plate is provided with the piezoelectric element, the center of the opening coincides with the center of the piezoelectric element, and the liquid is ink.

17. A printer comprising:

a mounting section on which a liquid containing section for containing a liquid is to be mounted removably, the liquid containing section being provided with a piezoelectric element at a predetermined position in the liquid containing section;

a drive signal generation section for generating a drive signal to be applied to the piezoelectric element; and a controller for applying the drive signal to the piezoelectric element, detecting an output signal from the piezoelectric element due to a residual vibration thereafter, and detecting whether or not the liquid is present at the predetermined position based on the output signal utilizing a difference in resonance frequency of the residual vibration depending on whether or not the liquid is present at the predetermined position, wherein the drive signal includes a first drive waveform portion for driving the piezoelectric element at a resonance frequency of the residual vibration when the liquid is present at the predetermined position and a second drive waveform portion for driving the piezoelectric element at a resonance frequency of the residual vibration when the liquid is not present at the predetermined position.

18. A printing system comprising:

a computer; and a printer connected to the computer, wherein the printer comprises:

a mounting section on which a liquid containing section for containing a liquid is mounted removably, the liquid containing section being provided with a piezoelectric element at a predetermined position in the liquid containing section;

a drive signal generation section for generating a drive signal to be applied to the piezoelectric element; and a controller for applying the drive signal to the piezoelectric element, detecting an output signal from the piezoelectric element due to a residual vibration thereafter, and detecting whether or not the liquid is present at the predetermined position based on the output signal utilizing difference in resonance frequency of the residual vibration depending on whether or not the liquid is present at the predetermined position, wherein the drive signal comprises a first drive waveform portion for driving the piezoelectric element at a resonance frequency of the residual vibration when the liquid is present at the predetermined position and a second drive waveform portion for driving the piezoelectric element at a resonance frequency of the residual vibration when the liquid is not present at the predetermined position.

* * * * *